US011319796B2

(12) United States Patent
Huang et al.

(10) Patent No.: US 11,319,796 B2
(45) Date of Patent: May 3, 2022

(54) METHOD FOR SELF-ADAPTIVE SURVEY CALCULATION OF WELLBORE TRAJECTORY

(71) Applicant: CHINA UNIVERSITY OF PETROLEUM (EAST CHINA), Qingdao (CN)

(72) Inventors: Genlu Huang, Qingdao (CN); Fan Yu, Qingdao (CN); Wei Li, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 17/522,791

(22) Filed: Nov. 9, 2021

(65) Prior Publication Data

US 2022/0065097 A1 Mar. 3, 2022

Related U.S. Application Data

(63) Continuation of application No. PCT/CN2020/102782, filed on Jul. 17, 2020.

(30) Foreign Application Priority Data

Jul. 16, 2020 (CN) ..... 202010684035.7

(51) Int. Cl.
*E21B 47/022* (2012.01)
*E21B 43/25* (2006.01)
*E21B 43/30* (2006.01)

(52) U.S. Cl.
CPC ..... *E21B 47/022* (2013.01); *E21B 43/25* (2013.01); *E21B 43/30* (2013.01)

(58) Field of Classification Search
CPC ..... E21B 47/022
(Continued)

(56) References Cited

U.S. PATENT DOCUMENTS 4,715,452 A 12/1987 Sheppard
8,433,551 B2 * 4/2013 Fung ..... E21B 43/00 703/10

(Continued)

FOREIGN PATENT DOCUMENTS

CN 101387198 A 3/2009
CN 101983276 A 3/2011

(Continued)

OTHER PUBLICATIONS

First Office Action and Search Report of the priority application CN202010684035.7, dated Jul. 16, 2020.

(Continued)

*Primary Examiner* — George B Bennett
(74) *Attorney, Agent, or Firm* — J.C. Patents

(57) ABSTRACT

The disclosure relates to a method for self-adaptive survey calculation of a wellbore trajectory in oil drilling, and belongs to the field of oil and gas drilling technologies. Curve characteristics of a calculated survey interval are identified by calculating measurement parameters of four survey stations corresponding to the survey interval and two survey intervals before and after the survey interval, so that an appropriate curve is selected to calculate a coordinate increment of the survey interval, then parameters of the curve characteristics which are close to the shape of the calculated wellbore trajectory are selected automatically, and the curve type which is closest to an actual wellbore trajectory is fitted automatically and the survey calculation is carried out.

7 Claims, 1 Drawing Sheet

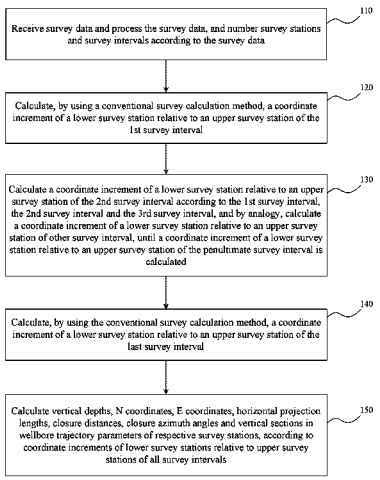

(58) Field of Classification Search
USPC ..... 33/304
See application file for complete search history.

(56) References Cited

U.S. PATENT DOCUMENTS

| | | | | |
|---|---|---|---|---|
| 9,297,924 | B2 * | 3/2016 | FitzSimmons | G01V 99/00 |
| 9,932,820 | B2 * | 4/2018 | Sugiura | G01C 17/38 |
| 10,132,119 | B2 * | 11/2018 | Spencer | E21B 7/04 |
| 10,317,555 | B2 * | 6/2019 | Li | G01V 1/40 |
| 10,626,716 | B2 * | 4/2020 | Hay | E21B 47/022 |
| 2009/0070042 | A1 * | 3/2009 | Birchwood | G01V 1/50 702/11 |
| 2012/0179445 | A1 | 7/2012 | Mitchell | |
| 2019/0169977 | A1 | 6/2019 | Maus | |
| 2021/0208298 | A1 * | 7/2021 | Vu | E21B 49/00 |
| 2021/0254448 | A1 * | 8/2021 | Phillips | E21B 7/06 |
| 2021/0262340 | A1 * | 8/2021 | Moody | E21B 47/022 |
| 2021/0277762 | A1 * | 9/2021 | Liu | E21B 49/005 |
| 2021/0332690 | A1 * | 10/2021 | Stishenko | E21B 44/00 |

FOREIGN PATENT DOCUMENTS

| | | | |
|---|---|---|---|
| CN | 103114846 | A | 5/2013 |
| CN | 106940742 | A | 7/2017 |
| CN | 106988726 | A | 7/2017 |
| CN | 107201894 | A | 9/2017 |
| CN | 108961352 | A | 12/2018 |
| WO | WO2010039317 | | 4/2010 |
| WO | WO2016137688 | | 9/2016 |
| WO | WO2017197203 | | 11/2017 |

OTHER PUBLICATIONS

Notice of Allowance and Search Report of the priority application CN202010684035.7, dated Feb. 5, 2021.

NPL1: "Objective description and calculation of drilled wellbore trajectories", Xiushan Liu, Acta Petrolei Sinica, vol. 28 No.5, pp. 128-132 and 138, Sep. 2007.

NPL2: "Discussion on the Spline Interpolation for Well Trajectory Coordinate Calculation", Tiezheng Chen et al., Sino-Global Energy, vol. 12, Issue 3, pp. 26-28, Dec. 2007.

International Search Report for PCT/CN2020/102782.

Written Opinion for PCT/CN2020/102782.

* cited by examiner

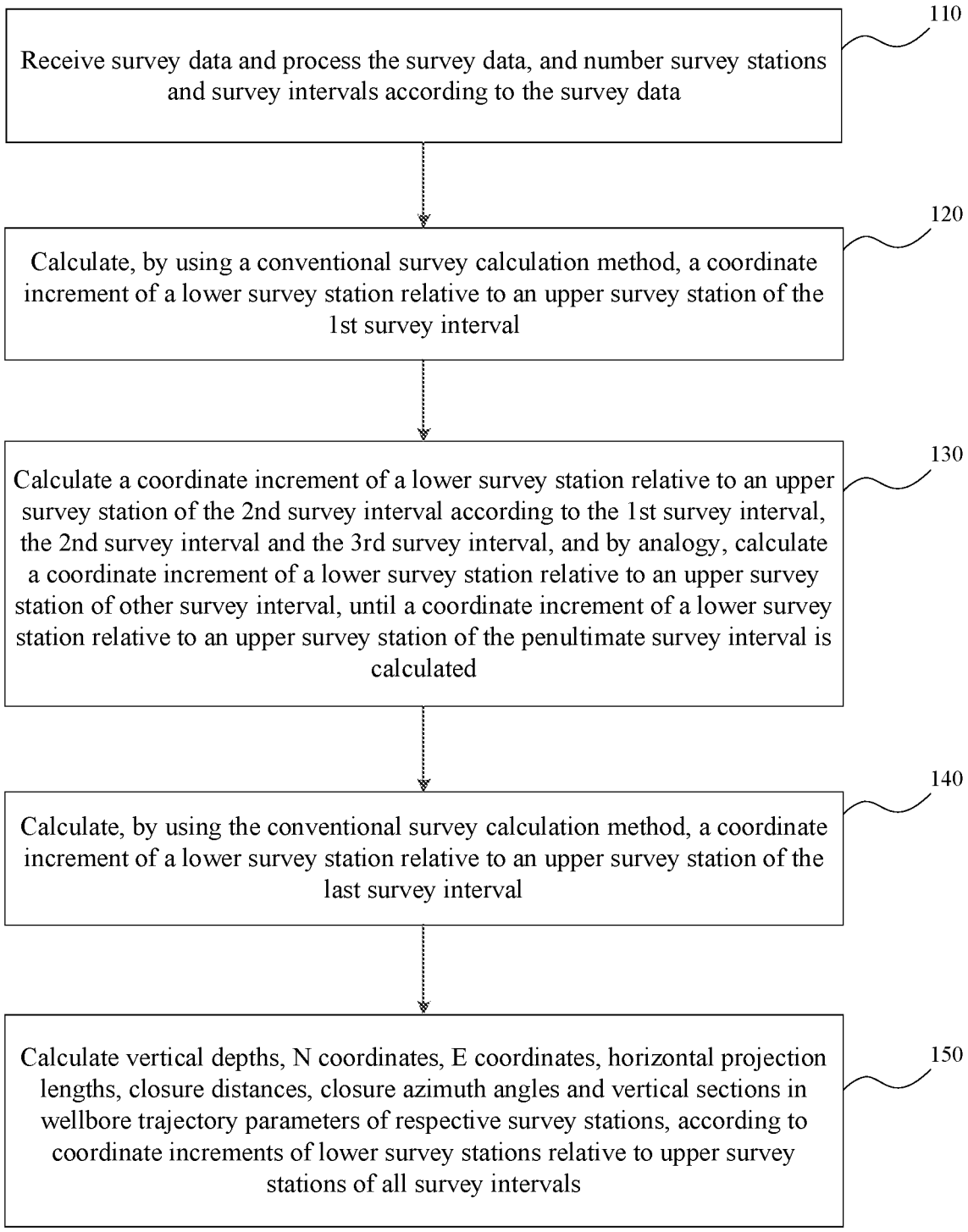
110
Receive survey data and process the survey data, and number survey stations and survey intervals according to the survey data
120
Calculate, by using a conventional survey calculation method, a coordinate increment of a lower survey station relative to an upper survey station of the 1st survey interval
130
Calculate a coordinate increment of a lower survey station relative to an upper survey station of the 2nd survey interval according to the 1st survey interval, the 2nd survey interval and the 3rd survey interval, and by analogy, calculate a coordinate increment of a lower survey station relative to an upper survey station of other survey interval, until a coordinate increment of a lower survey station relative to an upper survey station of the penultimate survey interval is calculated
140
Calculate, by using the conventional survey calculation method, a coordinate increment of a lower survey station relative to an upper survey station of the last survey interval
150
Calculate vertical depths, N coordinates, E coordinates, horizontal projection lengths, closure distances, closure azimuth angles and vertical sections in wellbore trajectory parameters of respective survey stations, according to coordinate increments of lower survey stations relative to upper survey stations of all survey intervals

METHOD FOR SELF-ADAPTIVE SURVEY CALCULATION OF WELLBORE TRAJECTORY

CROSS-REFERENCE TO RELATED APPLICATIONS

This application is a continuation of International Application No. PCT/CN2020/102782, filed on Jul. 17, 2020, which claims priority to Chinese Patent Application No. 202010684035.7, filed on Jul. 16, 2020. The disclosures of the aforementioned applications are hereby incorporated by reference in their entireties.

TECHNICAL FIELD

The present disclosure relates to the field of oil and gas drilling technologies, and in particular, to a method for self-adaptive survey calculation of a wellbore trajectory.

BACKGROUND

Survey calculation of a wellbore trajectory in petroleum drilling usually requires a curve type of a survey interval between two survey stations to be assumed, then a coordinate increment of the survey interval is determined according to characteristics of this type of curve and wellbore direction constraints at two ends, and thus coordinates of respective survey stations of the wellbore trajectory are determined.

However, since it is unknown what type of curve an actual wellbore trajectory between two survey stations is, if all survey intervals of any trajectory are assumed to be one type of curve for performing survey calculation, it will inevitably lead to larger trajectory calculation errors when the assumed curve is inconsistent with an actual curve of a survey interval.

Regarding this problem, a latest method for survey calculation takes well inclination angles and azimuth angles of respective survey stations obtained by actual measurement as sample points and adopts cubic spline interpolation to obtain cubic spline interpolation functions of the well inclination angles and the azimuth angles of respective survey intervals, and obtains the wellbore trajectory by numerical integration. Theoretically, this processing method reduces calculation errors of the wellbore trajectory to a certain extent. However, cubic spline interpolation requires that the second derivative of interpolation function is continuous at sample points (survey stations), and in actual drilling, the first derivative and the second derivative of the well inclination angle and the azimuth angle may change significantly due to changes in drilling assembly, stratum, drilling mode (sliding drilling or rotary drilling) and drilling parameters, etc., which may lead to the oscillation of the interpolation function and produce errors far exceeding expectations. In addition, this method is also very sensitive to errors of the sample points, and the shorter a survey interval, the higher the sensitivity, and even unreasonable oscillation may occur.

SUMMARY

The present disclosure provides a method for self-adaptive survey calculation of a wellbore trajectory, and aims to solve the problem of poor accuracy of survey calculation in the prior art. Curve characteristics of a calculated survey interval are identified by calculating measurement parameters of four survey stations corresponding to the survey interval and two survey intervals before and after the survey interval, so that an appropriate curve is selected to calculate a coordinate increment of the survey interval, which enables self-adaptive matching to curve characteristic parameters that are close to the shape of the wellbore trajectory of the survey interval to be calculated, and can significantly improve the accuracy of survey calculation of the wellbore trajectory.

A technical solution adopted by the present disclosure is as follows.

The present disclosure provides a method for self-adaptive survey calculation of a wellbore trajectory, including:

receiving survey data and processing the survey data, and numbering survey stations and survey intervals according to the survey data;

calculating, by using a conventional survey calculation method, a coordinate increment of a lower survey station relative to an upper survey station of a 1st survey interval;

calculating a coordinate increment of a lower survey station relative to an upper survey station of a 2nd survey interval according to the 1st survey interval, the 2nd survey interval and a 3rd survey interval, and calculating a coordinate increment of a lower survey station relative to an upper survey station of other survey interval by analogy, until a coordinate increment of a lower survey station relative to an upper survey station of a penultimate survey interval is calculated;

calculating, by using the conventional survey calculation method, a coordinate increment of a lower survey station relative to an upper survey station of a last survey interval;

calculating vertical depths, N coordinates, E coordinates, horizontal projection lengths, closure distances, closure azimuth angles and vertical sections in wellbore trajectory parameters of respective ones of the survey stations, according to coordinate increments of lower survey stations relative to upper survey stations of all the survey intervals.

Optionally, the coordinate increment includes a vertical depth increment, a horizontal projection length increment, an N coordinate increment and an E coordinate increment.

Optionally, the calculating a coordinate increment of a lower survey station relative to an upper survey station of a 2nd survey interval according to the 1st survey interval, the 2nd survey interval and a 3rd survey interval, specifically includes:

calculating estimated values of wellbore curvature, torsion and a tool face angle of the upper survey station of the 2nd survey interval according to well depths, well inclination angles and azimuth angles of three survey stations corresponding to the 1st survey interval and the 2nd survey interval;

calculating estimated values of wellbore curvature, torsion and a tool face angle of the lower survey station of the 2nd survey interval according to well depths, well inclination angles and azimuth angles of three survey stations corresponding to the 2nd survey interval and the 3rd survey interval;

calculating an estimated average change rate of wellbore curvature, an estimated average change rate of torsion, and an estimated tool face angle increment, between the upper survey station and the lower survey station of the 2nd survey interval;

determining a value range of wellbore curvature, a value range of torsion and a value range of tool face angle of the 2nd survey interval, by taking estimated wellbore curvature, estimated torsion and an estimated tool face angle of the upper survey station as reference values and taking ±10% of a wellbore curvature increment, ±10% of a torsion increment and ±10% of a tool face angle increment between the upper survey station and the lower survey station of the 2nd survey interval as fluctuation ranges;

determining, a value range of a change rate of the wellbore curvature and a value range of a change rate of the torsion of the 2nd survey interval, by taking the estimated average change rate of the wellbore curvature and the estimated average change rate of the torsion between the upper survey station and the lower survey station of the 2nd survey interval as reference values and fluctuating around the reference values up and down by 5%;

calculating the well inclination angle, the azimuth angle, the wellbore curvature and the torsion of the lower survey station of the 2nd survey interval, from the wellbore curvature, the torsion and the tool face angle of the upper survey station of the 2nd survey interval and the change rate of the wellbore curvature and the change rate of the torsion of the 2nd survey interval and within the determined value range of the change rate of the wellbore curvature and the determined value range of the change rate of the torsion of the 2nd survey interval;

calculating a comprehensive angular deviation between the calculated values and measured values of the well inclination angle and the azimuth angle at the lower survey station of the 2nd survey interval and a comprehensive deviation between the calculated values and estimated values of the curvature and the torsion at the upper survey station and the lower survey station of the 2nd survey interval; determining optimal values of the wellbore curvature, the torsion and the tool face angle of the upper survey station of the 2nd survey interval, and the change rate of the wellbore curvature and the change rate of the torsion of the 2nd survey interval, according to a principle of minimum comprehensive deviation of the curvature and the torsion of the upper survey station and the lower survey station of the 2nd survey interval on a premise that an angular deviation at the lower survey station of the 2nd survey interval is less than a specified value of 0.0002;

calculating the coordinate increment of the lower survey station relative to the upper survey station of the 2nd survey interval, according to the optimal values of the wellbore curvature, the torsion and the tool face angle of the upper survey station of the 2nd survey interval and the change rate of the wellbore curvature and the change rate of the torsion of the 2nd survey interval.

Optionally, the calculating, by using a conventional survey calculation method, a coordinate increment of a lower survey station relative to an upper survey station of a 1st survey interval, specifically includes:

calculating, according to a formula $\gamma_{01}=\arccos[\cos\alpha_0\cdot\cos\alpha_1+\sin\alpha_0\cdot\sin\alpha_1\cdot\cos(\varphi_1-\varphi_0)]$, a dogleg angle of the 1st survey interval, where $\gamma_{01}$ is the dogleg angle of the 1st survey interval; $\alpha_0$ is a well inclination angle of a 0th survey station, $\alpha_1$ is a well inclination angle of the 1st survey station, $\varphi_0$ is an azimuth angle of the 0th survey station, and $\varphi_1$ is an azimuth angle of the 1st survey station;

calculating, if the dogleg angle of the 1st survey interval is equal to zero, the coordinate increment of the lower survey station relative to the upper survey station of the 1st survey interval by using a following formula $$\begin{cases} \Delta D_{01} = (L_1 - L_0)\cdot\cos\alpha_0 \\ \Delta L_{p01} = (L_1 - L_0)\cdot\sin\alpha_0 \\ \Delta N_{01} = (L_1 - L_0)\cdot\sin\alpha_0\cdot\cos\varphi_0 \\ \Delta E_{01} = (L_1 - L_0)\cdot\sin\alpha_0\cdot\sin\varphi_0 \end{cases},$$

where $L_0$ is a well depth of the 0th survey station; $L_1$ is a well depth of the 1st survey station, $\Delta D_{01}$ is a vertical depth increment of the 1st survey interval, $\Delta L_{p01}$ is a horizontal projection length increment of the 1st survey interval, $\Delta N_{01}$ is an N coordinate increment of the 1st survey interval, and $\Delta E_{01}$ is an E coordinate increment of the 1st survey interval;

calculating, if the dogleg angle of the 1st survey interval is greater than zero, the coordinate increment of the lower survey station relative to the upper survey station of the 1st survey interval by using a following formula $$\begin{cases} \Delta D_{01} = R_{01}\cdot\tan(\gamma_{01}/2)\cdot(\cos\alpha_0 + \cos\alpha_1) \\ \Delta L_{p01} = R_{01}\cdot\tan(\gamma_{01}/2)\cdot(\sin\alpha_0 + \sin\alpha_1) \\ \Delta N_{01} = R_{01}\cdot\tan(\gamma_{01}/2)\cdot(\sin\alpha_0\cdot\cos\varphi_0 + \sin\alpha_1\cdot\cos\varphi_1) \\ \Delta E_{01} = R_{01}\cdot\tan(\gamma_{01}/2)\cdot(\sin\alpha_0\cdot\sin\varphi_0 + \sin\alpha_1\cdot\sin\varphi_1) \end{cases},$$

where $\Delta D_{01}$ is the vertical depth increment of the 1st survey interval, $\Delta L_{p01}$ is the horizontal projection length increment of the 1st survey interval, $\Delta N_{01}$ is the N coordinate increment of the 1st survey interval, $\Delta E_{01}$ is the E coordinate increment of the 1st survey interval, and $R_{01}$ is curvature radius of an arc of the 1st survey interval.

Optionally, the calculating, by using the conventional survey calculation method, a coordinate increment of a lower survey station relative to a previous survey station of a last survey interval, specifically includes:

calculating, according to a formula $\gamma_{(m-1)m}=\arccos[\cos\alpha_{m-1}\cos\alpha_m+\sin\alpha_{m-1}\sin\alpha_m\cos(\varphi_m-\varphi_{m-1})]$, a dogleg angle of the last survey interval, where $\gamma_{(m-1)m}$ is a dogleg angle of an mth survey interval, $\alpha_m$ is a well inclination angle of the mth survey station, $\varphi_m$ is an azimuth angle of the mth survey station, $\alpha_{m-1}$ is a well inclination angle of an (m−1)th survey station and $\varphi_{m-1}$ is an azimuth angle of the (m−1)th survey station;

calculating, if the dogleg angle of the mth survey interval is equal to zero, the coordinate increment of the lower survey station relative to the upper survey station of the mth survey interval by using a following formula $$\begin{cases} \Delta D_{(m-1)m} = (L_m - L_{m-1})\cdot\cos\alpha_m \\ \Delta L_{p(m-1)m} = (L_m - L_{m-1})\cdot\sin\alpha_m \\ \Delta N_{(m-1)m} = (L_m - L_{m-1})\cdot\sin\alpha_m\cdot\cos\varphi_m \\ \Delta E_{(m-1)m} = (L_m - L_{m-1})\cdot\sin\alpha_m\cdot\sin\varphi_m \end{cases},$$

where $L_m$ is a well depth of the mth survey station, $L_{m-1}$ is a well depth of the (m−1)th survey station, $\Delta D_{(m-1)m}$ is a vertical depth increment of the mth survey interval, $\Delta L_{p(m-1)m}$ is a horizontal projection length increment of the mth survey interval, $\Delta N_{(m-1)m}$ is an N coordinate increment of the mth survey interval, and $\Delta E_{(m-1)m}$ is an E coordinate increment of the mth survey interval;

calculating, if the dogleg angle of the mth survey interval is greater than zero, the coordinate increment of the lower survey station relative to the upper survey station of the mth survey interval by using a following formula $$\begin{cases} \Delta D_{(m-1)m} = R_{(m-1)m}\cdot\tan(\gamma_{(m-1)m}/2)\cdot(\cos\alpha_{m-1} + \cos\alpha_m) \\ \Delta L_{p(m-1)m} = R_{(m-1)m}\cdot\tan(\gamma_{(m-1)m}/2)\cdot(\sin\alpha_{m-1} + \sin\alpha_m) \\ \Delta N_{(m-1)m} = R_{(m-1)m}\cdot\tan(\gamma_{(m-1)m}/2)\cdot(\sin\alpha_{m-1}\cdot\cos\varphi_{m-1} + \sin\alpha_m\cdot\cos\varphi_m) \\ \Delta E_{(m-1)m} = R_{(m-1)m}\cdot\tan(\gamma_{(m-1)m}/2)\cdot(\sin\alpha_{m-1}\cdot\sin\varphi_{m-1} + \sin\alpha_m\cdot\sin\varphi_m) \end{cases},$$

where $\Delta D_{(m-1)m}$ is the vertical depth increment of the mth survey interval, $\Delta L_{p(m-1)m}$ is the horizontal projection length increment of the mth survey interval, $\Delta N_{(m-1)m}$ is the N coordinate increment of the mth survey interval, $\Delta E_{(m-1)m}$ is the E coordinate increment of the mth survey interval, and $R_{(m-1)m}$ is curvature radius of an arc of the mth survey interval.

Optionally, the calculating estimated values of wellbore curvature, torsion and a tool face angle of the upper survey station of the 2nd survey interval according to well depths, well inclination angles and azimuth angles of three survey stations corresponding to the 1st survey interval and the 2nd survey interval, specifically includes:

calculating, according to a formula $k_{1e}=\sqrt{k_{\alpha 1}^2+k_{\varphi 1}^2\sin\alpha_1^2}$, the estimated value of the wellbore curvature of the upper survey station of the 2nd survey interval, where $\alpha 1$ is a well inclination angle of a 1st survey station, $k_{1e}$ is an estimated value of wellbore curvature at the 1st survey station, $k_{\alpha 1}$ is a change rate of a well inclination angle at the 1st survey station, and $k_{\varphi 1}$ is a change rate of an azimuth angle at the 1st survey station;

calculating, according to a formula $$\tau_{1e}=\frac{k_{\alpha 1}k_{\varphi 1}k_{\alpha 1}}{k_{1e}^2}\sin\alpha_1+k_{\varphi 1}\left(1+\frac{k_{\alpha 1}^2}{k_{1e}^2}\right)\cos\alpha_1,$$

the estimated value of the torsion of the upper survey station of the 2nd survey interval, where, $\alpha 1$ is the well inclination angle of the 1st survey station, $k_{1e}$ is the estimated value of the wellbore curvature at the 1st survey station, $k_{\alpha 1}$ is the change rate of the well inclination angle at the 1st survey station, $k_{\varphi 1}$ is the change rate of the azimuth angle at the 1st survey station, $\dot{k}_{\alpha 1}$ is a change rate of the change rate of the well inclination angle at the 1st survey station, $\dot{k}_{\varphi 1}$ is a change rate of the change rate of the azimuth angle at the 1st survey station, and $\tau_{1e}$ is an estimated value of wellbore torsion at the 1st survey station;

calculating, according to a formula $$\omega_{1e}=\frac{1}{2}\left[\begin{array}{l}\operatorname{sgn}(\Delta\varphi_{01})\cdot\cos^{-1}\left(\frac{\cos\alpha_0-\cos\alpha_1\cos\gamma_{01}}{\sin\alpha_1\sin\gamma_{01}}\right)\\+\operatorname{sgn}(\Delta\varphi_{12})\cdot\cos^{-1}\left(\frac{\cos\alpha_1\cos\gamma_{12}-\cos\alpha_2}{\sin\alpha_1\sin\gamma_{12}}\right)\end{array}\right],$$

the estimated value of the tool face angle of the upper survey station of the 2nd survey interval, where, $\omega_{1e}$ is an estimated value of a tool face angle at the 1st survey station, $\Delta\varphi_{01}$ is an azimuth angle increment of the 1st survey interval, $\Delta\varphi_{12}$ is an azimuth angle increment of the 2nd survey interval, $\alpha_1$ is the well inclination angle of the 1st survey station, $\alpha_0$ is an well inclination angle of a 0th survey station, $\alpha_2$ is the well inclination angle of the 2nd survey station, $\gamma_{01}$ is a dogleg angle of the 1st survey interval, and $\gamma_{12}$ is a dogleg angle of the 2nd survey interval.

Optionally, the calculating estimated values of wellbore curvature, torsion and a tool face angle of the lower survey station of the 2nd survey interval according to well depths, well inclination angles and azimuth angles of three survey stations corresponding to the 2nd survey interval and the 3rd survey interval, specifically includes:

calculating, according to a formula $k_{2e}=\sqrt{k_{\alpha 2}^2+k_{\varphi 2}^2\sin_{\alpha 2}^2}$, the estimated value of the wellbore curvature of the lower survey station of the 2nd survey interval where $\alpha 2$ is a well inclination angle of a 2nd survey station, $k_{2e}$ is an estimated value of wellbore curvature at the 2nd survey station, $k_{\alpha 2}$ is a change rate of the well inclination angle at the 2nd survey station, and $k_{\varphi 2}$ is a change rate of an azimuth angle at the 2nd survey station;

calculating, according to a formula $$\tau_{2e}=\frac{k_{\alpha 2}k_{\varphi 2}-k_{\varphi 2}k_{\alpha 2}}{k_{2e}^2}\sin\alpha_2+k_{\varphi 2}\left(1+\frac{k_{\alpha 2}^2}{k_{2e}^2}\right)\cos\alpha_2,$$

the estimated value of the torsion of the lower survey station of the 2nd survey interval, where $\alpha 2$ is the well inclination angle of the 2nd survey station, $k_{2e}$ is the estimated value of the wellbore curvature at the 2nd survey station, $k_{\alpha 2}$ is the change rate of the well inclination angle at the 2nd survey station, $k_{\varphi 2}$ is the change rate of the azimuth angle at the 2nd survey station, $\dot{k}_{\alpha 2}$ is a change rate of the change rate of the well inclination angle at the 2nd survey station, $\dot{k}_{\varphi 2}$ is a change rate of the change rate of the azimuth angle at the 2nd survey station, and $\tau_{2e}$ is an estimated value of wellbore torsion at the 2nd survey station;

calculating, according to a formula $$\omega_{2e}=\frac{1}{2}\left[\begin{array}{l}\operatorname{sgn}(\Delta\varphi_{12})\cdot\cos^{-1}\left(\frac{\cos\alpha_1-\cos\alpha_2\cos\gamma_{12}}{\sin\alpha_2\sin\gamma_{12}}\right)\\+\operatorname{sgn}(\Delta\varphi_{23})\cdot\cos^{-1}\left(\frac{\cos\alpha_2\cos\gamma_{23}-\cos\alpha_3}{\sin\alpha_2\sin\gamma_{23}}\right)\end{array}\right],$$

the estimated value of the tool face angle of the lower measuring point of the 2nd survey interval, where $\omega_{2e}$ is an estimated value of a tool face angle at the 2nd survey station, $\Delta\varphi_{12}$ is an azimuth angel increment of the 2nd survey interval, $\Delta\varphi_{23}$ is an azimuth angel increment of the 3rd survey interval, $\alpha_2$ is a well inclination angle of the 2nd survey station, $\alpha_1$ is a well inclination angle of the 1st survey station, $\alpha_3$ is a well inclination angle of a 3rd survey station, $\gamma_{12}$ is a dogleg angle of the 2nd survey interval, $\gamma_{23}$ is a dogleg angle of the 3rd survey interval.

Optionally, the calculating an estimated average change rate of wellbore curvature, an estimated average change rate of torsion, and an estimated tool face angle increment, between an upper survey station and a lower survey station of a 2nd survey interval, specifically includes:

calculating, according to a formula $$A_{k12}=\frac{k_{2e}-k_{1e}}{L_2-L_1},$$

the estimated average change rate of well bore curvature between the upper survey station and the lower survey station of the 2nd survey interval, where $A_{k12}$ is an average change rate of wellbore curvature of the 2nd survey interval, $L_1$ is a well depth of a 1st survey station, $L_2$ is a well depth of a 2nd survey station, $k_{1e}$ is an estimated value of wellbore curvature at the 1st survey station, and $k_{2e}$ is an estimated value of wellbore curvature at the 2nd survey station;

calculating, according to a formula $$A_{\tau 12}=\frac{\tau_{2e}-\tau_{1e}}{L_2-L_1},$$

the estimated average change rate of the torsion between the upper survey station and the lower survey station of the 2nd survey interval, where $A_{\tau 12}$ is an average change rate of wellbore torsion of the 2nd survey interval, $\tau_{1e}$ is an estimated value of wellbore torsion at the 1st survey station, and $\tau_{2e}$ is an estimated value of wellbore torsion at the 2nd survey station;

calculating, according to a formula $$\Delta\omega_{12} = \begin{cases} (\omega_{2e} - \omega_{1e} + 2\pi) & (\omega_{2e} - \omega_{1e} < -\pi) \\ (\omega_{2e} - \omega_{1e}) & (-\pi \le \omega_{2e} - \omega_{1e} \le -\pi) \\ (\omega_{2e} - \omega_{1e} - 2\pi) & (\omega_{2e} - \omega_{1e} > -\pi) \end{cases},$$

the estimated tool face angle increment between the upper survey station and the lower survey station of the 2nd survey interval, where $\Delta\omega_{12}$ is a tool face angle increment of the 2nd survey interval, $\omega_{1e}$ is an estimated value of a tool face angle at the 1st survey station, and $\omega_{2e}$ is an estimated value of a tool face angle at the 2nd survey station.

Compared with the prior art, the present disclosure has the following beneficial effects. The coordinate increment of the 1st survey interval is calculated according to the survey data of the 0th survey station and the 1st survey station of the wellbore trajectory by using a currently conventional method for survey calculation (minimum curvature method or curvature radius method), then assuming that the curvature and the torsion both change linearly from the 2nd survey interval to the penultimate survey interval, the curvature, the torsion and the tool face angle at the 1st survey station are first calculated from the survey data of the 0th survey station, the 1st survey station and the 2nd survey station, and the change rate of curvature and the change rate of torsion of the 2nd survey interval are determined by taking the well inclination angle and the azimuth angle at the 2nd survey station as constraints, and on this basis, the coordinate increment of the 2nd survey interval is obtained by numerical integration; similar steps are repeated until the coordinate increment of the penultimate survey interval is calculated; next, the coordinate increment of the last survey interval is calculated by using the currently conventional method for survey calculation; finally, all trajectory parameters at all survey stations can be calculated according to the full trajectory parameters at the 0th survey station and coordinate increments of respective survey intervals; then curve characteristics parameters that are close to the shape of the calculated wellbore trajectory are selected automatically according to the change rules of the well inclination angel and the azimuth angle of the calculated survey interval and the survey intervals before and after the calculated survey interval, and the curve type which is closest to the actual wellbore trajectory is fitted automatically and the survey calculation is carried out, and thus an error caused by the mismatch between the assumed curve type and the actual wellbore trajectory curve is avoided, the accuracy of the survey calculation of the wellbore trajectory is significantly improved, which has important significance in relief wells, interconnecting wells, parallel horizontal wells and avoidance of collisions between dense wellbores.

BRIEF DESCRIPTION OF DRAWINGS

FIG. 1 is a schematic flow chart of a method for self-adaptive survey calculation of a wellbore trajectory according to an embodiment of the present disclosure.

DESCRIPTION OF EMBODIMENTS

In order to make the object, technical solution and advantages of the present disclosure clearer, the embodiments of the present disclosure are further described in detail below.

The method for self-adaptive survey calculation of a wellbore trajectory according to an embodiment of the present disclosure will be described in detail with reference to FIG. 1.

Referring to FIG. 1, an embodiment of the present disclosure provides a method for self-adaptive survey calculation of a wellbore trajectory.

Step 110: receive survey data and process the survey data, and number survey stations and survey intervals according to the survey data.

Specifically, a survey station which is the first one with a non-zero well inclination angle is the 1st survey station, and then the numbers of following survey stations are increased in turn until the last survey station. A position which is above the 1st survey station and the well depth of which is 25 m smaller than the depth of the 1st survey station is the 0th survey station. If the well depth of the 1st survey station is less than 25 m, the 0th survey station is a wellhead. In addition, a survey interval between the 0th survey station and the 1st survey station is a 1st survey interval, and by analogy, a survey interval between an (i−1)th survey station and an ith survey station is an ith survey interval, where i is a positive integer greater than or equal to 1.

For example, a survey station which is the first one with a non-zero well inclination angle is the 1st survey station, followed by the 2nd survey station, the 3rd survey station . . . in turn, until the last survey station which is the mth survey station. The 0th survey station is at a position which is above the 1st survey station and which has a well depth 25 m smaller than the depth of the 1st survey station, and if the well depth of the 1st survey station is less than 25 m, the 0th survey station is a wellhead, i.e.

$$L_0 = \begin{cases} L_1 - 25 & (L_1 > 25m) \\ 0 & (L_1 \le 25m) \end{cases}, \tag{1}$$

where, $L_0$ is the well depth of the 0th survey station, m; $L_1$ is the well depth of the 1st survey station, m.

Other parameters of the 0th survey station are:

$$\begin{cases} \alpha_0 = 0 \\ \varphi_0 = 0 \\ D_0 = L_0 \\ L_{p0} = 0 \\ N_0 = 0 \\ E_0 = 0 \\ S_0 = 0 \\ \theta_0 = 0 \end{cases}, \tag{2}$$

where, $\alpha_0$ is a well inclination angle of the 0th survey station, °; $\varphi_0$ is an azimuth angle of the 0th survey station, °; $D_0$ is a vertical depth of the 0th survey station, m; $L_{p0}$ is a horizontal projection length of the 0th survey station, m; $N_0$ is an N coordinate of the 0th survey station, m; $E_0$ is an E coordinate of the 0th survey station, m; $S_0$ is a closure distance of the 0th survey station, m; $\theta_0$ is a closure azimuth angle of the 0th survey station, °.

On the basis of the numbering of survey stations, a survey interval between the (i−1)th survey station and the ith survey station is the ith survey interval, and i can range from 1 to m.

Step 120: calculate, by using a conventional survey calculation method, a coordinate increment of a lower survey station relative to an upper survey station of the 1st survey interval;

where the coordinate increment includes a vertical depth increment, a horizontal projection length increment, an N coordinate increment and an E coordinate increment.

A dogleg angle of the 1st survey interval is calculated according to a formula $\gamma_{01}=\arccos[\cos\alpha_0\cdot\cos\alpha_1+\sin\alpha_0\cdot\sin\alpha_1\cdot\cos(\varphi_1-\varphi_0)]$ where $\gamma_{01}$ is the dogleg angle of the 1st survey interval, °; $\alpha_0$ is the well inclination angle of the 0th survey station, °; $\alpha_1$ is the well inclination angle of the 1st survey station, °; $\varphi_0$ is the azimuth angle of the 0th survey station, °; and $\varphi_1$ is an azimuth angle of the 1st survey station, °;

If the dogleg angle of the 1st survey interval is equal to zero, the coordinate increment of the lower survey station relative to the upper survey station of the 1st survey interval is calculated by using a following formula $$\begin{cases} \Delta D_{01} = (L_1 - L_0)\cdot\cos\alpha_0 \\ \Delta L_{p01} = (L_1 - L_0)\cdot\sin\alpha_0 \\ \Delta N_{01} = (L_1 - L_0)\cdot\sin\alpha_0\cdot\cos\varphi_0 \\ \Delta E_{01} = (L_1 - L_0)\cdot\sin\alpha_0\cdot\sin\varphi_0 \end{cases},$$

where $L_0$ is a well depth of the 0th survey station, m; $L_1$ is the well depth of the 1st survey station, m; $\Delta D_{01}$ is the vertical depth increment of the 1st survey interval, m; $\Delta L_{p01}$ is the horizontal projection length increment of the 1st survey interval, m; $\Delta N_{01}$ is the N coordinate increment of the 1st survey interval, m; and $\Delta E_{01}$ is the E coordinate increment of the 1st survey interval, m.

If the dogleg angle of the 1st survey interval is greater than zero, the coordinate increment of the lower survey station relative to the upper survey station of the 1st survey interval is calculated by using a following formula $$\begin{cases} \Delta D_{01} = R_{01}\cdot\tan(\gamma_{01}/2)\cdot(\cos\alpha_0 + \cos\alpha_1) \\ \Delta L_{p01} = R_{01}\cdot\tan(\gamma_{01}/2)\cdot(\sin\alpha_0 + \sin\alpha_1) \\ \Delta N_{01} = R_{01}\cdot\tan(\gamma_{01}/2)\cdot(\sin\alpha_0\cdot\cos\varphi_0 + \sin\alpha_1\cdot\cos\varphi_1) \\ \Delta E_{01} = R_{01}\cdot\tan(\gamma_{01}/2)\cdot(\sin\alpha_0\cdot\sin\varphi_0 + \sin\alpha_1\cdot\sin\varphi_1) \end{cases},$$

where $\Delta D_{01}$ is the vertical depth increment of the 1st survey interval, m; $\Delta L_{p01}$ is the horizontal projection length increment of the 1st survey interval, m; $\Delta N_{01}$ is the N coordinate increment of the 1st survey interval, m; $\Delta E_{01}$ is the E coordinate increment of the 1st survey interval, m; and $R_{01}$ is curvature radius of an arc of the 1st survey interval, m.

$$\gamma_{01} = \arccos[\cos\alpha_0\cdot\cos\alpha_1 + \sin\alpha_0\cdot\sin\alpha_1\cdot\cos(\varphi_1 - \varphi_0)], \quad (3)$$

when $\gamma_{01} = 0$:

$$\begin{cases} \Delta D_{01} = (L_1 - L_0)\cdot\cos\alpha_0 \\ \Delta L_{p01} = (L_1 - L_0)\cdot\sin\alpha_0 \\ \Delta N_{01} = (L_1 - L_0)\cdot\sin\alpha_0\cdot\cos\varphi_0 \\ \Delta E_{01} = (L_1 - L_0)\cdot\sin\alpha_0\cdot\sin\varphi_0 \end{cases}, \quad (4)$$

when $\gamma_{01} > 0$:

-continued $$R_{01} = (L_1 - L_0)/\gamma_{01}, \quad (5)$$

$$\begin{cases} \Delta D_{01} = R_{01}\cdot\tan(\gamma_{01}/2)\cdot(\cos\alpha_0 + \cos\alpha_1) \\ \Delta L_{p01} = R_{01}\cdot\tan(\gamma_{01}/2)\cdot(\sin\alpha_0 + \sin\alpha_1) \\ \Delta N_{01} = R_{01}\cdot\tan(\gamma_{01}/2)\cdot(\sin\alpha_0\cdot\cos\varphi_0 + \sin\alpha_1\cdot\cos\varphi_1) \\ \Delta E_{01} = R_{01}\cdot\tan(\gamma_{01}/2)\cdot(\sin\alpha_0\cdot\sin\varphi_0 + \sin\alpha_1\cdot\sin\varphi_1) \end{cases}, \quad (6)$$

where, $\gamma_{01}$ is the dogleg angle of the 1st survey interval, °; $\alpha_1$ is the well inclination angle of the 1st survey station, °; $\varphi_1$ is the azimuth angle of the 1st survey station, °; $\Delta D_{01}$ is the vertical depth increment of the 1st survey interval, m; $\Delta L_{p01}$ is the horizontal projection length increment of the 1st survey interval, m; $\Delta N_{01}$ is the N coordinate increment of the 1st survey interval, m; $\Delta E_{01}$ is the E coordinate increment of the 1st survey interval, m; and $R_{01}$ is the curvature radius of the arc of the 1st survey interval, m; other parameters are the same as before.

Step 130: calculate the coordinate increment of a lower survey station relative to an upper survey station of the 2nd survey interval according to the 1st survey interval, the 2nd survey interval and the 3rd survey interval, and by analogy, calculate a coordinate increment of a lower survey station relative to an upper survey station of other survey interval, until a coordinate increment of a lower survey station relative to an upper survey station of the penultimate survey interval is calculated.

Specifically, step 130 includes following sub-steps.

(1) Calculate estimated values of wellbore curvature, torsion and a tool face angle of the upper survey station of the 2nd survey interval according to well depths, well inclination angles and azimuth angles of three survey stations corresponding to the 1st survey interval and the 2nd survey interval.

The estimated value of the wellbore curvature of the upper survey station of the 2nd survey interval is calculated according to a formula $k_{1e}=\sqrt{k_{\alpha1}^2+k_{\varphi1}^2\sin\alpha_1^2}$, where $\alpha1$ is the well inclination angle of the 1st survey station, $k_{1e}$ is an estimated value of wellbore curvature at the 1st survey station, $k_{\alpha1}$ is a change rate of the well inclination angle at the 1st survey station, and $k_{\varphi1}$ is an change rate of the azimuth angle at the 1st survey station;

The estimated value of the torsion of the upper survey station of the 2nd survey interval is calculated according to a formula $$\tau_{1e} = \frac{k_{\alpha1}k_{\varphi1} - k_{\varphi1}k_{\alpha1}}{k_{1e}^2}\sin\alpha_1 + k_{\varphi1}\left(1 + \frac{k_{\alpha1}^2}{k_{1e}^2}\right)\cos\alpha_1,$$

where $\alpha1$ is the well inclination angle of the 1st survey station, $k_{1e}$ is the estimated value of the wellbore curvature at the 1st survey station, $k_{\alpha1}$ is the change rate of the well inclination angle at the 1st survey station, $k_{\varphi1}$ is the change rate of the azimuth angle at the 1st survey station, $\dot{k}_{\alpha1}$ is a change rate of the change rate of the well inclination angle at the 1st survey station, $\dot{k}_{\varphi1}$ is a change rate of the change rate of the azimuth angle at the 1st survey station, and $\tau_{1e}$ is an estimated value of wellbore torsion at the 1st survey station.

The estimated value of the tool face angle of the upper survey station of the 2nd survey interval is calculated according to a formula $$\omega_{1e} = \frac{1}{2}\left[\mathrm{sgn}(\Delta\varphi_{01})\cdot\cos^{-1}\left(\frac{\cos\alpha_0 - \cos\alpha_1\cos\gamma_{01}}{\sin\alpha_1\sin\gamma_{01}}\right) + \mathrm{sgn}(\Delta\varphi_{12})\cdot\cos^{-1}\left(\frac{\cos\alpha_1\cos\gamma_{12} - \cos\alpha_2}{\sin\alpha_1\sin\gamma_{12}}\right)\right],$$

where, $\omega_{1e}$ is an estimated value of a tool face angle at the 1st survey station, $\Delta\varphi_{01}$ is an azimuth angle increment of the 1st survey interval, $\Delta\varphi_{12}$ is an azimuth angle increment of the 2nd survey interval, $\alpha_1$ is the well inclination angle of the 1st survey station, $\alpha_0$ is the well inclination angle of the 0th survey station, $\alpha_2$ is a well inclination angle of the 2nd survey station, $\gamma_{01}$ is the dogleg angle of the 1st survey interval, $\gamma_{12}$ is a dogleg angle of the 2nd survey interval.

Specifically, the estimated values of the wellbore curvature, torsion and tool face angle of the upper survey station of the 2nd survey interval are calculated according to well depths, well inclination angles and azimuth angles of three survey stations corresponding to the 1st survey interval and the 2nd survey interval, by using following formulas.

$$\Delta\varphi_{01} = \begin{cases} (\varphi_1 - \varphi_0 + 2\pi) & (\varphi_1 - \varphi_0 < -\pi) \\ (\varphi_1 - \varphi_0) & (-\pi \le \varphi_1 - \varphi_0 \le \pi) \\ (\varphi_1 - \varphi_0 - 2\pi) & (\varphi_1 - \varphi_0 > \pi) \end{cases}, \tag{7}$$

$$\Delta\varphi_{12} = \begin{cases} (\varphi_2 - \varphi_1 + 2\pi) & (\varphi_2 - \varphi_1 < -\pi) \\ (\varphi_2 - \varphi_1) & (-\pi \le \varphi_2 - \varphi_1 \le \pi) \\ (\varphi_2 - \varphi_1 - 2\pi) & (\varphi_2 - \varphi_1 > \pi) \end{cases}, \tag{8}$$

$$\gamma_{01} = \cos^{-1}[\cos\alpha_0\cos\alpha_1 + \sin\alpha_0\sin\alpha_1\cos(\varphi_1 - \varphi_0)], \tag{9}$$

$$\gamma_{12} = \cos^{-1}[\cos\alpha_1\cos\alpha_2 + \sin\alpha_1\sin\alpha_2\cos(\varphi_2 - \varphi_1)], \tag{10}$$

$$k_{\alpha 01} = \frac{\alpha_1 - \alpha_0}{L_1 - L_0}, \tag{11}$$

$$k_{\varphi 01} = \frac{\Delta\varphi_{01}}{L_1 - L_0}, \tag{12}$$

$$k_{\alpha 12} = \frac{\alpha_2 - \alpha_1}{L_2 - L_1}, \tag{13}$$

$$k_{\varphi 12} = \frac{\Delta\varphi_{12}}{L_2 - L_1}, \tag{14}$$

$$k_{\alpha 1} = \frac{k_{\alpha 01}(L_2 - L_1) + k_{\alpha 12}(L_1 - L_0)}{L_2 - L_0}, \tag{15}$$

$$k_{\varphi 1} = \frac{k_{\varphi 01}(L_2 - L_1) + k_{\varphi 12}(L_1 - L_0)}{L_2 - L_0}, \tag{16}$$

$$\dot{k}_{\alpha 1} = \frac{k_{\alpha 12} - k_{\alpha 01}}{(L_2 - L_0)/2}, \tag{17}$$

$$\dot{k}_{\varphi 1} = \frac{k_{\varphi 12} - k_{\varphi 01}}{(L_2 - L_0)/2}, \tag{18}$$

$$k_{ie} = \sqrt{k_{\alpha i}^2 + k_{\varphi i}^2\sin\alpha_i^2}, \tag{19}$$

$$\tau_{1e} = \frac{k_{\alpha 1}k_{\varphi 1} - k_{\varphi 1}k_{\alpha 1}}{k_{1e}^2}\sin\alpha_1 + k_{\varphi 1}\left(1 + \frac{k_{\alpha 1}^2}{k_{1e}^2}\right)\cos\alpha_1, \tag{20}$$

$$\omega_{1e} = \frac{1}{2}\left[\mathrm{sgn}(\Delta\varphi_{01})\cdot\cos^{-1}\left(\frac{\cos\alpha_0 - \cos\alpha_1\cos\gamma_{01}}{\sin\alpha_1\sin\gamma_{01}}\right) + \mathrm{sgn}(\Delta\varphi_{12})\cdot\cos^{-1}\left(\frac{\cos\alpha_1\cos\gamma_{12} - \cos\alpha_2}{\sin\alpha_1\sin\gamma_{12}}\right)\right], \tag{21}$$

where, $\Delta\varphi_{01}$ is the azimuth angle increment of the 1st survey interval, °; $\Delta\varphi_{12}$ is the azimuth angle increment of the 2nd survey interval, °; $\gamma_{12}$ is the dogleg angle of the 2nd survey interval, °; $k_{\alpha 01}$ is an average change rate of the well inclination angle of the 1st survey interval, °/m; $k_{\varphi 01}$ is an average change rate of the azimuth angle of the 1st survey interval, °/m; $k_{\alpha 12}$ is an average change rate of the well inclination angle of the 2nd survey interval, °/m; $k_{\varphi 12}$ is an average change rate of the azimuth angle of the 2nd survey interval, °/m; $k_{\alpha 1}$ is the change rate of the well inclination angle at the 1st survey station, °/m; $k_{\varphi 1}$ is the change rate of the azimuth angle at the 1st survey station, °/m; $\dot{k}_{\alpha 1}$ is the change rate of the change rate of the well inclination angle at the 1st survey station, °/m$^2$; $\dot{k}_{\varphi 1}$ is the change rate of the change rate of the azimuth angle at the 1st survey station, °/m$^2$; $k_{1e}$ is the estimated value of the wellbore curvature at the 1st survey station, °/m; $\tau_{1e}$ is the estimated value of the wellbore torsion at the 1st survey station, °/m; and $\omega_{1e}$ is the estimated value of the tool face angle at the 1st survey station, °; other parameters are the same as before.

(2) Calculate estimated values of wellbore curvature, torsion and a tool face angle of the lower survey station of the 2nd survey interval according to well depths, well inclination angles and azimuth angles of three survey stations corresponding to the 2nd survey interval and the 3rd survey interval.

The estimated value of the wellbore curvature of the lower survey station of the 2nd survey interval is calculated according to a formula $k_{2e}=\sqrt{k_{\alpha 2}^2+k_{\varphi 2}^2\sin\alpha_2^2}$, where $\alpha 2$ is the well inclination angle of the 2nd survey station, $k_{2e}$ is an estimated value of wellbore curvature at the 2nd survey station, $k_{\alpha 2}$ is a change rate of the well inclination angle at the 2nd survey station, and $k_{\varphi 2}$ is a change rate of an azimuth angle at the 2nd survey station.

The estimated value of the torsion of the lower survey station of the 2nd survey interval is calculated according to a formula $$\tau_{2e} = \frac{k_{\alpha 2}k_{\varphi 2} - k_{\varphi 2}k_{\alpha 2}}{k_{2e}^2}\sin\alpha_2 + k_{\varphi 2}\left(1 + \frac{k_{\alpha 2}^2}{k_{2e}^2}\right)\cos\alpha_2,$$

where $\alpha 2$ is the well inclination angle of the 2nd survey station, $k_{2e}$ is the estimated value of the wellbore curvature at the 2nd survey station, $k_{\alpha 2}$ is the change rate of the well inclination angle at the 2nd survey station, $k_{\varphi 2}$ is the change rate of the azimuth angle at the 2nd survey station, $\dot{k}_{\alpha 2}$ is a change rate of the change rate of the well inclination angle at the 2nd survey station, $\dot{k}_{\varphi 2}$ is a change rate of the change rate of the azimuth angle at the 2nd survey station, and $\tau_{2e}$ is an estimated value of wellbore torsion at the 2nd survey station.

The estimated value of the tool face angle of the lower survey station of the 2nd survey interval is calculated according to a formula $$\omega_{2e} = \frac{1}{2}\left[\mathrm{sgn}(\Delta\varphi_{12})\cdot\cos^{-1}\left(\frac{\cos\alpha_1 - \cos\alpha_2\cos\gamma_{12}}{\sin\alpha_2\sin\gamma_{12}}\right) + \mathrm{sgn}(\Delta\varphi_{23})\cdot\cos^{-1}\left(\frac{\cos\alpha_2\cos\gamma_{23} - \cos\alpha_3}{\sin\alpha_2\sin\gamma_{23}}\right)\right],$$

where $\omega_{2e}$ is the estimated value of a tool face angle at the 2nd survey station, $\Delta\varphi_{12}$ is the azimuth angle increment of the 2nd survey interval, $\Delta\varphi_{23}$ is an azimuth increment of the 3rd survey interval, $\alpha_2$ is a well inclination angle of the 2nd survey station, $\alpha_1$ is the well inclination angle of the 1st survey station, $\alpha_3$ is a well inclination angle of a 3rd survey station, $\gamma_{12}$ is a dogleg angle of the 2nd survey interval, $\gamma_{23}$ is a dogleg angle of the 3rd survey interval.

Specifically, the estimated values of the wellbore curvature, torsion and tool face angle of the lower survey station of the 2nd survey interval are calculated according to the well depths, well inclination angles and azimuth angles of the three survey stations corresponding to the 2nd survey interval and the third survey interval by using the following formulas.

$$\Delta\varphi_{23} = \begin{cases} (\varphi_3 - \varphi_2 + 2\pi) & (\varphi_3 - \varphi_2 < -\pi) \\ (\varphi_3 - \varphi_2) & (-\pi \le \varphi_3 - \varphi_2 \le \pi), \\ (\varphi_3 - \varphi_2 - 2\pi) & (\varphi_3 - \varphi_2 > \pi) \end{cases} \tag{22}$$

$$\gamma_{23} = \cos^{-1}[\cos\alpha_2\cos\alpha_3 + \sin\alpha_2\sin\alpha_3\cos(\varphi_3 - \varphi_2)], \tag{23}$$

$$k_{\alpha 23} = \frac{\alpha_3 - \alpha_2}{L_3 - L_2}, \tag{24}$$

$$k_{\varphi 23} = \begin{cases} \dfrac{(\varphi_3 - \varphi_2 + 2\pi)}{L_3 - L_2} & (\varphi_3 - \varphi_2 < -\pi) \\ \dfrac{(\varphi_3 - \varphi_2)}{L_3 - L_2} & (-\pi \le \varphi_3 - \varphi_2 \le \pi), \\ \dfrac{(\varphi_3 - \varphi_2 - 2\pi)}{L_3 - L_2} & (\varphi_3 - \varphi_2 > \pi) \end{cases} \tag{25}$$

$$k_{\alpha 2} = \frac{k_{\alpha 12}(L_3 - L_2) + k_{\alpha 23}(L_2 - L_1)}{L_3 - L_1}, \tag{26}$$

$$k_{\varphi 2} = \frac{k_{\varphi 12}(L_3 - L_2) + k_{\varphi 23}(L_2 - L_1)}{L_3 - L_1}, \tag{27}$$

$$\dot{k}_{\alpha 2} = \frac{k_{\alpha 23} - k_{\alpha 12}}{(L_3 - L_1)/2}, \tag{28}$$

$$\dot{k}_{\varphi 2} = \frac{k_{\varphi 23} - k_{\varphi 12}}{(L_3 - L_1)/2}, \tag{29}$$

$$k_{2e} = \sqrt{k_{\alpha 2}^2 + k_{\varphi 2}^2 \sin\alpha_2^2}, \tag{30}$$

$$\tau_{2e} = \frac{k_{\alpha 2}k_{\varphi 2} - k_{\varphi 2}k_{\alpha 2}}{k_{2e}^2}\sin\alpha_2 + k_{\varphi 2}\left(1 + \frac{k_{\alpha 2}^2}{k_{2e}^2}\right)\cos\alpha_2, \tag{31}$$

$$\omega_{2e} = \frac{1}{2}\left[\mathrm{sgn}(\Delta\varphi_{12})\cdot\cos^{-1}\left(\frac{\cos\alpha_1 - \cos\alpha_2\cos\gamma_{12}}{\sin\alpha_2\sin\gamma_{12}}\right) + \mathrm{sgn}(\Delta\varphi_{23})\cdot\cos^{-1}\left(\frac{\cos\alpha_2\cos\gamma_{23} - \cos\alpha_3}{\sin\alpha_2\sin\gamma_{23}}\right)\right], \tag{32}$$

where $\Delta\varphi_{23}$ is the azimuth angle increment of the 3rd survey interval, °; $\gamma_{23}$ is the dogleg angle of the 3rd survey interval, °; $k_{\alpha 23}$ is an average change rate of the well inclination angle of the 3rd survey interval, °/m; $k_{\varphi 23}$ is an average change rate of the azimuth angle of the 3rd survey interval, °/m; $k_{\alpha 2}$ is the change rate of the well inclination angle at the 2nd survey station, °/m; $k_{\varphi 2}$ is the change rate of the azimuth angle at the 2nd survey station, °/m; $\dot{k}_{\alpha 2}$ is a change rate of the change rate of the well inclination angle at the 2nd survey station, °/m$^2$; $\dot{k}_{\varphi 2}$ is a change rate of the change rate of the azimuth angle at the 2nd survey station, °/m$^2$; $k_{2e}$ is the estimated value of the wellbore curvature at the 2nd survey station, °/m; $\tau_{2e}$ is the estimated value of the wellbore torsion at the 2nd survey station, °/m; and $\omega_{2e}$ is the estimated value of the tool face angle at the 2nd survey station, °; other parameters are the same as before.

(3) Calculate an estimated average change rate of wellbore curvature, an estimated average change rate of torsion, and an estimated tool face angle increment, between the upper survey station and the lower survey station of the 2nd survey interval.

An estimated average change rate of wellbore curvature between an upper survey station and a lower survey station of a 2nd survey interval is calculated according to a formula $$A_{k12} = \frac{k_{2e} - k_{1e}}{L_2 - L_1},$$

where $A_{k12}$ is an average change rate of the wellbore curvature of the 2nd survey interval, $L_1$ is the well depth of the 1$^{st}$ survey station, $L_2$ is a well depth of the 2nd survey station, $k_{1e}$ is the estimated value of the wellbore curvature at the 1st survey station, and $k_{2e}$ is the estimated value of the wellbore curvature at the 2nd survey station;

An estimated average change rate of torsion between the upper survey station and the lower survey station of the 2nd survey interval is calculated according to a formula $$A_{\tau 12} = \frac{\tau_{2e} - \tau_{1e}}{L_2 - L_1},$$

where $A_{\tau 12}$ is an average change rate of wellbore torsion of the 2nd survey interval, $\tau_{1e}$ is the estimated value of the wellbore torsion at the 1st survey station, and $\tau_{2e}$ is the estimated value of the wellbore torsion at the 2nd survey station;

An estimated tool face angle increment between the upper survey station and the lower survey station of the 2nd survey interval is calculated according to a formula $$\Delta\omega_{12} = \begin{cases} (\omega_{2e} - \omega_{1e} + 2\pi) & (\omega_{2e} - \omega_{1e} < -\pi) \\ (\omega_{2e} - \omega_{1e}) & (-\pi \le \omega_{2e} - \omega_{1e} \le \pi), \\ (\omega_{2e} - \omega_{1e} - 2\pi) & (\omega_{2e} - \omega_{1e} > \pi) \end{cases}$$

where $\Delta\varphi_{12}$ is the tool face angle increment of the 2nd survey interval, $\omega_{1e}$ is the estimated value of the tool face angle at the 1st survey station, and $\omega_{2e}$ is the estimated value of the tool face angle at the 2nd survey station.

Specifically, the process of calculating the estimated average change rate of the wellbore curvature, the estimated average change rate of the torsion and the estimated tool face angle increment, between the upper survey station and the lower survey station of the 2nd survey interval is as follows:

$$A_{k12} = \frac{k_{2e} - k_{1e}}{L_2 - L_1}, \tag{33}$$

$$A_{\tau 12} = \frac{\tau_{2e} - \tau_{1e}}{L_2 - L_1}, \tag{34}$$

$$\Delta\omega_{12} = \begin{cases} (\omega_{2e} - \omega_{1e} + 2\pi) & (\omega_{2e} - \omega_{1e} < -\pi) \\ (\omega_{2e} - \omega_{1e}) & (-\pi \le \omega_{2e} - \omega_{1e} \le \pi), \\ (\omega_{2e} - \omega_{1e} - 2\pi) & (\omega_{2e} - \omega_{1e} > \pi) \end{cases} \tag{35}$$

where $A_{k12}$ is the average change rate of the wellbore curvature of the 2nd survey interval, °/m$^2$; $A_{\tau 12}$ is the average change rate of the wellbore torsion of the 2nd survey interval, °/m$^2$; $\Delta\omega_{12}$ is the tool face angle increment of the 2nd survey interval, °; other parameters are the same as before.

(4) Determine a value range of the wellbore curvature, a value range of the torsion and a value range of the tool face angle of the 2nd survey interval, by taking the estimated wellbore curvature, the estimated torsion and the estimated tool face angle of the upper survey station as reference values and taking ±10% of the wellbore curvature increment, ±10% of the torsion increment and ±10% of the tool face angle increment between the upper survey station and the lower survey station of the 2nd survey interval as fluctuation ranges.

Specifically, the estimated values of the wellbore curvature, the torsion and the tool face angle of the upper survey station (the 1st survey station) of the 2nd survey interval are taken as references, and upper and lower limits fluctuate around the reference values up and down by 10% of the variation ranges of the corresponding estimated values of the survey interval, namely $$k_{1max}=k_{1e}+A_{k12}\cdot(L_2-L_1)\cdot 10\% \quad (36),$$

$$k_{1min}=k_{1e}-A_{k12}\cdot(L_2-L_1)\cdot 10\% \quad (37),$$

$$\tau_{1max}=\tau_{1e}+A_{\tau 12}\cdot(L_2-L_1)\cdot 10\% \quad (38),$$

$$\tau_{1min}=\tau_{1e}-A_{12\tau 12}\cdot(L_2-L_1)\cdot 10\% \quad (39),$$

$$\omega_{1max}=\omega_{1e}+\Delta\omega_{12}\cdot 10\% \quad (40),$$

$$\omega_{1min}=\omega_{1e}-\Delta\omega_{12}\cdot 10\% \quad (41),$$

where $k_{1max}$ is an upper limit of a search interval of wellbore curvature at the 1st survey station, °/m; $k_{1min}$ is a lower limit of the search interval of wellbore curvature at the 1st survey station, °/m; $\tau_{1max}$ is an upper limit of a search interval of wellbore torsion at the 1st survey station, °/m; $\tau_{1min}$ is a lower limit of the search interval of wellbore torsion at the 1st survey station, °/m; $\omega_{1max}$ is an upper limit of a search interval of the tool face angle at the 1st survey station, °; $\omega_{1min}$ is a lower limit of the search interval of the tool face angle at the 1st survey station, °; other parameters are the same as before.

(5) Determine a value range of the change rate of the wellbore curvature and a value range of the change rate of the torsion of the 2nd survey interval by taking the average change rate of the wellbore curvature and the average change rate of the torsion between the upper survey station and the lower survey station of the 2nd survey interval as the reference values, and fluctuating around the reference values up and down by 5%.

Specifically, the value range of the change rate of the wellbore curvature and the value range of the change rate of the torsion of the 2nd survey interval are determined according to the following formulas by taking the average change rate of the wellbore curvature and the average change rate of the torsion between the upper survey station and the lower survey station of the 2nd survey interval as the reference values and taking up and down fluctuations of 5% of the reference values.

$$A_{kmax}=1.05\cdot A_{k12} \quad (42),$$

$$A_{kmin}=0.95\cdot A_{k12} \quad (43),$$

$$A_{\tau max}=1.05\cdot A_{\tau 12} \quad (44),$$

$$A_{\tau min}=0.95\cdot A_{\tau 12} \quad (45),$$

where $A_{kmax}$ is an upper limit of a search interval of the wellbore curvature change rate of the 2nd survey interval, °/m; $A_{kmin}$ is a lower limit of the search interval of the wellbore curvature change rate of the 2nd survey interval, °/m; $A_{\tau max}$ is an upper limit of a search interval of the change rate of the wellbore torsion of the 2nd survey interval, °/m; $A_{\tau min}$ is a lower limit of the search interval of the change rate of the wellbore torsion of the 2nd survey interval, °/m; other parameters are the same as before.

(6) Calculate the well inclination angle, the azimuth angle, the wellbore curvature and the torsion of the lower survey station of the 2nd survey interval, from the wellbore curvature, the torsion and the tool face angle of the upper survey station of the 2nd survey interval and the change rate of section curvature and the change rate of the torsion of the 2nd survey interval and within the determined range of the change rate of the wellbore curvature and the determined range of the change rate of the torsion of the 2nd survey interval.

Specifically, parameter such as the well inclination angle, the azimuth angle, the wellbore curvature, the torsion and the tool face angle of the lower survey station of the 2nd survey interval are calculated from the wellbore curvature, the torsion and the tool face angle of the upper survey station and the change rate of the wellbore curvature and the change rate of the torsion of the survey interval and within the determined range of the change rate of the wellbore curvature and the change rate of the torsion of the 2nd survey interval, by using following formulas. Specific calculation process is as follows:

① Divide the survey interval into several segments n, where a segment length is ds;

② Parameters at a starting point of a 1st segment s=0 are:

$$\alpha(0)=\alpha_1 \quad (46),$$

$$\varphi(0)=\varphi_1 \quad (47),$$

$$k(0)=k_{1c} \quad (48),$$

$$\tau(0)=\tau_{1c} \quad (49),$$

$$\omega(0)=\omega_{1c} \quad (50),$$

where $k_{1c}$, $\tau_{1c}$, $\omega_{1c}$, $A_{kc}$ and $A_{\tau c}$ are respectively certain values of the wellbore curvature, the wellbore torsion, the tool face angle of the upper survey station of the 2nd survey interval, and the change rate of the wellbore curvature and the change rate of wellbore torsion of the 2nd survey interval in their respective search intervals; $\alpha(0)$, $\varphi(0)$, $k(0)$, $\tau(0)$ and $\omega(0)$ are respectively a well inclination angle, an azimuth angle, wellbore curvature, wellbore torsion and a tool face angle at the well depth of s=0 from the upper survey station on the 2nd survey interval; and they are parameters corresponding to different depths when s takes different values.

③ Calculate parameters at s=(i+1)·ds from parameters at s=i·ds, $$\alpha((i+1)\cdot ds)=\alpha(i\cdot ds)+k(i\cdot ds)\cdot\cos\omega(i\cdot ds)\cdot ds \quad (51),$$

$$\varphi((i+1)\cdot ds)=\varphi(i\cdot ds)+k(i\cdot ds)\cdot\sin\omega(i\cdot ds)/\sin\alpha(i\cdot ds)\cdot ds \quad (52),$$

$$k((i+1)\cdot ds)=k(i\cdot ds)+A_{kc}\cdot ds \quad (53),$$

$$\tau((i+1)\cdot ds)=\tau(i\cdot ds)+A_{\tau c}\cdot ds \quad (54),$$

$$\omega((i+1)\cdot ds)=\omega(i\cdot ds)+[\tau(i\cdot ds)-k(i\cdot ds)\cdot\sin\omega(i\cdot ds)/\sin\alpha(i\cdot ds)\cdot\cos\alpha(i\cdot ds)]\cdot ds \quad (55),$$

(i=0, . . . , n−1).

④ Parameters at the lower survey station (the 2nd survey station) of the 2nd survey interval are parameters at the end point of the nth section s=n·ds, $$\alpha_{2c}=\alpha(n\cdot ds) \quad (56),$$

$$\varphi_{2c}=\varphi(n\cdot ds) \quad (57),$$

$$k_{2c}=k(n\cdot ds) \quad (58),$$

$$\tau_{2c}=\tau(n\cdot ds) \quad (59),$$

$$\omega_{2c}=\omega(n\cdot ds) \quad (60),$$

where $\alpha_{2c}$, $\varphi_{2c}$, $k_{2c}$, $\tau_{2c}$ and $\omega_{2c}$ are respectively the well inclination angle, the azimuth angle, the wellbore curvature, the wellbore torsion and the tool face angle at the lower survey station calculated from the set of values ($k_{1c}$, $\tau_{1c}$, $\omega_{1c}$, $A_{kc}$, $A_{\tau c}$) at the upper survey station of the 2nd survey interval.

For example, the 2nd survey interval is divided into several segments first, initial values for iteration are determined according to the formulas (46)-(50) from the wellbore curvature, the torsion, the tool face angle of the upper survey station of the 2nd survey interval, and the change rate of the wellbore curvature and the change rate of the torsion of the 2nd survey interval; and parameters of the next point are calculated from parameters of the previous point according to iterative formats of the formulas (51)-(55) until the lower survey station of the 2nd survey interval; that is, the well inclination angle, the azimuth angle, the wellbore curvature and the torsion of the lower survey station can be calculated.

(7) Calculate a comprehensive angular deviation between the calculated values and measured values of the well inclination angle and the azimuth angle at the lower survey station of the 2nd survey interval and a comprehensive deviation between the calculated values and estimated values of the curvature and the torsion at the upper survey station and lower survey station of the 2nd survey interval; determine optimal values of the wellbore curvature, the torsion and the tool face angle of the upper survey station of the 2nd survey interval, and the change rate of the wellbore curvature and the change rate of the torsion of the 2nd survey interval according to a principle of minimum comprehensive deviation of the curvature and the torsion of the upper survey station and the lower survey station of the 2nd survey interval on the premise that an angular deviation at the lower survey station of the 2nd survey interval is less than a specified value of 0.0002.

Errors $\Delta_1$ and $\Delta_2$ for any group of values ($k_{1c}$, $\tau_{1c}$, $\varphi_{1c}$, $A_{kc}$, $A_{\tau c}$) are calculated by using following formulas.

$$\Delta_1=\sqrt{(\alpha_{2c}-\alpha_2)^2+(\varphi_{2c}-\varphi_2)^2\sin\alpha_2^2} \quad (61),$$

$$\Delta_2=\sqrt{(k_{1c}-k_{1e})^2+(k_{2c}-k_{2e})^2+(\tau_{1c}-\tau_{1e})^2+(\tau_{2c}-\tau_{2e})^2} \quad (62).$$

(8) Calculate the coordinate increment of the lower survey station relative to the upper survey station of the 2nd survey interval, according to the optimal values of the wellbore curvature, the torsion and the tool face angle of the upper survey station of the 2nd survey interval and the change rate of the wellbore curvature and the change rate of the torsion of the 2nd survey interval.

Specifically, in given value ranges, a group of values ($k_{1c}$, $\tau_{1c}$, $\omega_{1c}$, $A_{kc}$, $A_{\tau c}$) satisfying $\Delta_1<0.0002$ and having a minimum $\Delta_2$ are determined as the optimal values ($k_{1opt}$, $\tau_{1opt}$, $\varphi_{1opt}$, $A_{kopt}$, $A_{\tau opt}$).

Then, the coordinate increment of the lower survey station relative to the upper survey station of the 2nd survey interval is calculated from the optimal values ($k_{1opt}$, $\tau_{1opt}$, $\omega_{1opt}$, $A_{kopt}$, $A_{\tau opt}$) of the upper survey station (the 1st survey station) of the 2nd survey interval. Specific calculation process is as follows:

① Divide the survey interval into several segments n, where a segment length is ds;

② Parameters at a starting point of a 1st segment s=0 are:

$$\alpha(0)=\alpha_1 \quad (63),$$

$$\varphi(0)=\varphi_1 \quad (64),$$

$$k(0)=k_{1opt} \quad (65),$$

$$\tau(0)=\tau_{1opt} \quad (66),$$

$$\omega(0)=\omega_{1opt} \quad (67).$$

③ Calculate parameters at s=(i+1)·ds from parameters at s=i·ds, $$\alpha((i+1)\cdot ds)=\alpha(i\cdot ds)+k(i\cdot ds)\cdot\cos\omega(i\cdot ds)\cdot ds \quad (68),$$

$$\varphi((i+1)\cdot ds)=\varphi(i\cdot ds)+k(i\cdot ds)\cdot\sin\omega(i\cdot ds)/\sin\alpha(i\cdot ds)\cdot ds \quad (69),$$

$$k((i+1)\cdot ds)=k(i\cdot ds)+A_{kopt}\cdot ds \quad (70),$$

$$\tau((i+1)\cdot ds)=\tau(i\cdot ds)+A_{\tau opt}\cdot ds \quad (71),$$

$$\omega((i+1)\cdot ds)=\omega(i\cdot ds)+[\tau(i\cdot ds)-k(i\cdot ds)\cdot\sin\omega(i\cdot ds)/\sin\alpha(si\cdot ds)\cdot\cos\alpha(i\cdot ds)]\cdot ds \quad (72),$$

(i=0, . . . , n−1).

④ The coordinate increment of the lower survey station relative to the upper survey station of the 2nd survey interval $$\begin{cases} \Delta D_{12}=\left[\dfrac{\cos\alpha(0)+\cos\alpha(n\cdot ds)}{2}+\sum_{i=1}^{n-1}\cos\alpha(i\cdot ds)\right]\cdot ds \\ \Delta L_{p12}=\left[\dfrac{\sin\alpha(0)+\sin\alpha(n\cdot ds)}{2}+\sum_{i=1}^{n-1}\sin\alpha(i\cdot ds)\right]\cdot ds \\ \Delta N_{12}=\left[\dfrac{\sin\alpha(0)\cdot\cos\varphi(0)+\sin\alpha(n\cdot ds)\cdot\cos\varphi(n\cdot ds)}{2}+\sum_{i=1}^{n-1}\sin\alpha(i\cdot ds)\cdot\sin\varphi(i\cdot ds)\right]\cdot ds \\ \Delta E_{12}=\left[\dfrac{\sin\alpha(0)\cdot\sin\varphi(0)+\sin\alpha(n\cdot ds)\cdot\sin\varphi(n\cdot ds)}{2}+\sum_{i=1}^{n-1}\sin\alpha(i\cdot ds)\cdot\sin\varphi(i\cdot ds)\right]\cdot \end{cases}, \quad (73)$$

$$(i=0,\ldots,n-1)$$

where $\Delta D_{12}$ is the vertical depth increment of the 2nd survey interval, m; $\Delta L_{p12}$ is the horizontal projection length increment of the 2nd survey interval, m; $\Delta N_{12}$ is the N coordinate increment of the 2nd survey interval, m; $\Delta E_{12}$ is the E coordinate increment of the 2nd survey interval, m; other parameters are the same as before.

For example, the 2nd survey interval is divided into several segments first, initial values for iteration are determined according to the formulas (63)-(67) from the optimal values of the wellbore curvature, the torsion, the tool face angle of the upper survey station of the 2nd survey interval, and the change rate of the wellbore curvature and the change rate of the torsion of the 2nd survey interval; and parameters of the next point are calculated from parameters of the previous point according to iterative formats of the formulas (68)-(72) until the lower survey station of the 2nd survey interval; finally, the coordinate increment of the lower survey station relative to the upper survey station of the 2nd survey interval is calculated according to the formula (73).

Step 140: calculate, by using the conventional survey calculation method, a coordinate increment of a lower survey station relative to an upper survey station of the last survey interval.

A dogleg angle of the last survey interval is calculated according to a formula $\gamma_{(m-1)m}$=arccos[cos $\alpha_{m-1}$ cos $\alpha_m$+sin $\alpha_{m-1}$ sin $\alpha_m$ cos($\varphi_m$−$\varphi_{m-1}$)], where $\gamma_{(m-1)m}$ is a dogleg angle of an mth survey interval, $\alpha_m$ is a well inclination angle of the mth survey station, $\varphi_m$ is an azimuth angle of the mth survey station, $\alpha_{m-1}$ is a well inclination angle of an (m−1)th survey station and $\varphi_{m-1}$ is an azimuth angle of the (m−1)th survey station;

If the dogleg angle of the mth survey interval is equal to zero, the coordinate increment of the lower survey station relative to the upper survey station of the mth survey interval is calculated by using following formulas $$\begin{cases} \Delta D_{(m-1)m} = (L_m - L_{m-1}) \cdot \cos\alpha_m \\ \Delta L_{p(m-1)m} = (L_m - L_{m-1}) \cdot \sin\alpha_m \\ \Delta N_{(m-1)m} = (L_m - L_{m-1}) \cdot \sin\alpha_m \cdot \cos\varphi_m \\ \Delta E_{(m-1)m} = (L_m - L_{m-1}) \cdot \sin\alpha_m \cdot \sin\varphi_m \end{cases},$$

where $L_m$ is a well depth of the mth survey station, m; $L_{m-1}$ is a well depth of the (m−1)th survey station, m; $\Delta D_{(m-1)m}$ is a vertical depth increment of the mth survey interval, m; $\Delta L_{p(m-1)m}$ is a horizontal projection length increment of the mth survey interval, m; $\Delta N_{(m-1)m}$ is an N coordinate increment of the mth survey interval, m; and $\Delta E_{(m-1)m}$ is an E coordinate increment of the mth survey interval, m.

If the dogleg angle of the mth survey interval is greater than zero, the coordinate increment of the lower survey station relative to the upper survey station of the $m^{th}$ survey interval is calculated by using following formulas $$\begin{cases} \Delta D_{(m-1)m} = R_{(m-1)m} \cdot \tan(\gamma_{(m-1)m}/2) \cdot (\cos\alpha_{m-1} + \cos\alpha_m) \\ \Delta L_{p(m-1)m} = R_{(m-1)m} \cdot \tan(\gamma_{(m-1)m}/2) \cdot (\sin\alpha_{m-1} + \sin\alpha_m) \\ \Delta N_{(m-1)m} = R_{(m-1)m} \cdot \tan(\gamma_{(m-1)m}/2) \cdot (\sin\alpha_{m-1} \cdot \cos\varphi_{m-1} + \sin\alpha_m \cdot \cos\varphi_m) \\ \Delta E_{(m-1)m} = R_{(m-1)m} \cdot \tan(\gamma_{(m-1)m}/2) \cdot (\sin\alpha_{m-1} \cdot \sin\varphi_{m-1} + \sin\alpha_m \cdot \sin\varphi_m) \end{cases},$$

where $\Delta D_{(m-1)m}$ is the vertical depth increment of the mth survey interval, m; $\Delta L_{p(m-1)m}$ is the horizontal projection length increment of the mth survey interval, m; $\Delta N_{(m-1)m}$ is the N coordinate increment of the mth survey interval, m; $\Delta E_{(m-1)m}$ is the E coordinate increment of the mth survey interval, m; and $R_{(m-1)m}$ is curvature radius of an arc of the mth survey interval, m.

For example, specific calculation formulas are as follows:

$$\gamma_{(m-1)m} = \arccos[\cos\alpha_{m-1}\cos\alpha_m + \sin\alpha_{m-1}\sin\alpha_m\cos(\varphi_m - \varphi_{m-1})], \tag{74}$$

when $\gamma_{(m-1)m} = 0$:

$$\begin{cases} \Delta D_{(m-1)m} = (L_m - L_{m-1}) \cdot \cos\alpha_m \\ \Delta L_{p(m-1)m} = (L_m - L_{m-1}) \cdot \sin\alpha_m \\ \Delta N_{(m-1)m} = (L_m - L_{m-1}) \cdot \sin\alpha_m \cdot \cos\varphi_m \\ \Delta E_{(m-1)m} = (L_m - L_{m-1}) \cdot \sin\alpha_m \cdot \sin\varphi_m \end{cases}, \tag{75}$$

when $\gamma_{(m-1)m} > 0$:

$$R_{(m-1)m} = (L_m - L_{m-1})/\gamma_{(m-1)m}, \tag{76}$$

$$\begin{cases} \Delta D_{(m-1)m} = R_{(m-1)m} \cdot \tan(\gamma_{(m-1)m}/2) \cdot (\cos\alpha_{m-1} + \cos\alpha_m) \\ \Delta L_{p(m-1)m} = R_{(m-1)m} \cdot \tan(\gamma_{(m-1)m}/2) \cdot (\sin\alpha_{m-1} + \sin\alpha_m) \\ \Delta N_{(m-1)m} = R_{(m-1)m} \cdot \tan(\gamma_{(m-1)m}/2) \cdot (\sin\alpha_{m-1} \cdot \cos\varphi_{m-1} + \sin\alpha_m \cdot \cos\varphi_m) \\ \Delta E_{(m-1)m} = R_{(m-1)m} \cdot \tan(\gamma_{(m-1)m}/2) \cdot (\sin\alpha_{m-1} \cdot \sin\varphi_{m-1} + \sin\alpha_m \cdot \sin\varphi_m) \end{cases}, \tag{77}$$

where $\gamma_{(m-1)m}$ is the dogleg angle of the mth survey interval, °; $\alpha_{m-1}$ is the well inclination angle of an (m−1)th survey station, °; $\varphi_{m-1}$ is an azimuth angle of the (m−1)th survey station, °; $\Delta D_{(m-1)m}$ is the vertical depth increment of the mth survey interval, m; $\Delta L_{p(m-1)m}$ is the horizontal projection length increment of the mth survey interval, m; $\Delta N_{(m-1)m}$ is the N coordinate increment of the mth survey interval, m; $\Delta E_{(m-1)m}$ is the E coordinate increment of the mth survey interval, m; $R_{(m-1)m}$ is curvature radius of the arc of the mth survey interval, m; other parameters are the same as before.

Step 150: calculate vertical depths, N coordinates, E coordinates, horizontal projection lengths, closure distances, closure azimuth angles and vertical sections in wellbore trajectory parameters of respective survey stations, according to coordinate increments of lower survey stations relative to upper survey stations of all survey intervals.

Specifically, the wellbore trajectory parameters such as the vertical depth, the horizontal projection length, the N coordinate, the E coordinate, the horizontal displacement, the translation azimuth angle and the vertical section of the lower survey station are calculated from the parameters of the upper survey station and the coordinate increment data of the survey interval.

$$D_i = D_{i-1} + \Delta D_{(i-1)i}, \tag{78}$$

$$L_{pi} = L_{p(i-1)} + \Delta L_{p(i-1)i}, \tag{79}$$

$$N_i = N_{i-1} + \Delta N_{(i-1)i}, \tag{80}$$

$$E_i = E_{i-1} + \Delta E(i-1)i, \tag{81}$$

$$S_i = \sqrt{N_i^2 + E_i^2}, \tag{82}$$

$$\theta_i = \begin{cases} \arctan\left(\frac{E_i}{N_i}\right) & (N_i > 0) \\ \frac{n}{2} & (N_i = 0, E_i \geq 0) \\ 3\frac{\pi}{2} & (N_i = 0, E_i < 0) \\ \arctan\left(\frac{E_i}{N_i}\right) + \pi & (N_i < 0) \end{cases}, \tag{83}$$

$$V_i = S_i \cdot \cos(\theta_i - \theta_{TB}), \tag{85}$$

where $D_i$, $L_{pi}$, $N_i$, $E_i$, $S_i$, $\theta_i$ and $V_i$ are respectively a vertical depth, a horizontal projection length, an N coordinate, an E coordinate, a closure distance, a closure azimuth angle and a vertical section of an ith survey station; $D_{i-1}$, $L_{p(i-1)}$, $N_{i-1}$ and $E_{i-1}$ are respectively a vertical depth, a horizontal projection length, an N coordinate and an E coordinate of an (i−1)th survey station; $\Delta D_{(i-1)i}$, $\Delta L_{P(i-1)i}$, $\Delta N_{(i-1)i}$ and $\Delta E_{(i-1)i}$ are respectively a vertical depth increment, a horizontal projection length increment, an N coordinate increment and an E coordinate increment of the ith survey interval; $\theta_{TB}$ is a design azimuth angle of the well.

In the method for self-adaptive survey calculation of a wellbore trajectory according to the embodiment of the disclosure, first, the coordinate increment of the 1st survey interval is calculated according to the survey data of the 0th survey station and the 1st survey station of the wellbore trajectory by using a currently conventional method for survey calculation (minimum curvature method or curvature radius method). Next, assuming that the curvature and the torsion both change linearly from the 2nd survey interval to the penultimate survey interval, and the curvature, the torsion and the tool face angle at the 1st survey station are first calculated from the survey data of the 0th survey station, the 1st survey station and the 2nd survey station, and the change rate of the curvature and the torsion of the 2nd survey interval are determined by taking the well inclination angle and azimuth angle at the 2nd survey station as constraints, and on this basis, the coordinate increment of the 2nd survey interval is obtained by numerical integration. Similar steps are performed until the coordinate increment of the penultimate survey interval is calculated. Then, the coordinate increment of the last survey interval is calculated by using the currently conventional method for survey calculation. Finally, all trajectory parameters at all survey stations can be calculated according to all trajectory parameters at the 0th survey station and coordinate increments of respective survey intervals. Then, the curve characteristics parameters which are closer to the shape of the calculated wellbore trajectory are selected automatically, and the curve type which is closest to an actual wellbore trajectory is fitted automatically and the survey calculation is carried out, and thus an error caused by the mismatch between the assumed curve type and the actual wellbore trajectory curve is avoided, the accuracy of the survey calculation of the wellbore trajectory is significantly improved, which has important significance in relief wells, interconnecting wells, parallel horizontal wells and avoidance of collisions between dense wellbores.

Obviously, those skilled in the art can make various modifications and variations to the embodiments of the present disclosure without departing from the spirit and scope of the embodiments of the present disclosure. In this way, if these modifications and variations of the embodiments of the present disclosure fall within the scope of the claims and their equivalent technologies, the present disclosure is also intended to include these modifications and variations.

What is claimed is:

1. A method for self-adaptive survey calculation of a wellbore trajectory, wherein the method for self-adaptive survey calculation of the wellbore trajectory comprises:

receiving survey data and processing the survey data, and numbering survey stations and survey intervals according to the survey data;

calculating, by using a conventional survey calculation method, a coordinate increment of a lower survey station relative to an upper survey station of a 1st survey interval;

calculating a coordinate increment of a lower survey station relative to an upper survey station of a 2nd survey interval according to the 1st survey interval, the 2nd survey interval and a 3rd survey interval, and calculating a coordinate increment of a lower survey station relative to an upper survey station of other survey interval by analogy, until a coordinate increment of a lower survey station relative to an upper survey station of a penultimate survey interval is calculated;

calculating, by using the conventional survey calculation method, a coordinate increment of a lower survey station relative to an upper survey station of a last survey interval;

calculating vertical depths, N coordinates, E coordinates, horizontal projection lengths, closure distances, closure azimuth angles and vertical sections in wellbore trajectory parameters of respective ones of the survey stations, according to coordinate increments of lower survey stations relative to upper survey stations of all the survey intervals;

wherein the calculating a coordinate increment of a lower survey station relative to an upper survey station of a 2nd survey interval according to the 1st survey interval, the 2nd survey interval and a 3rd survey interval, comprises:

calculating estimated values of wellbore curvature, torsion and a tool face angle of the upper survey station of the 2nd survey interval according to well depths, well inclination angles and azimuth angles of three survey stations corresponding to the 1st survey interval and the 2nd survey interval;

calculating estimated values of wellbore curvature, torsion and a tool face angle of the lower survey station of the 2nd survey interval according to well depths, well inclination angles and azimuth angles of three survey stations corresponding to the 2nd survey interval and the 3rd survey interval;

calculating an estimated average change rate of wellbore curvature, an estimated average change rate of torsion and an estimated tool face angle increment, between the upper survey station and the lower survey station of the 2nd survey interval;

determining a value range of wellbore curvature, a value range of torsion and a value range of tool face angle of the 2nd survey interval by taking the estimated values of the wellbore curvature, the torsion and the tool face angle of the upper survey station as reference values and taking ±10% of a wellbore curvature increment, ±10% of a torsion increment and ±10% of a tool face angle increment between the upper survey station and the lower survey station of the 2nd survey interval as fluctuation ranges;

determining a value range of a change rate of the wellbore curvature and a value range of a change rate of the torsion of the 2nd survey interval, by taking the estimated average change rate of the wellbore curvature and the estimated average change rate of the torsion between the upper survey station and the lower survey station of the 2nd survey interval as reference values and fluctuating around the reference values up and down by 5%;

calculating the well inclination angle, the azimuth angle, the wellbore curvature and the torsion of the lower survey station of the 2nd survey interval, from the wellbore curvature, the torsion and the tool face angle of the upper survey station of the 2nd survey interval and the change rate of the wellbore curvature and the change rate of the torsion of the 2nd survey interval and within the determined value range of the change rate of the wellbore curvature and the determined value range of the change rate of the torsion of the 2nd survey interval;

calculating a comprehensive angular deviation between the calculated values and measured values of the well inclination angle and the azimuth angle at the lower survey station of the 2nd survey interval and a comprehensive deviation between the calculated values and estimated values of the curvature and the torsion at the upper survey station and lower survey station of the 2nd survey interval; determining optimal values of the wellbore curvature, the torsion and the tool face angle of the upper survey station of the 2nd survey interval and the change rate of the wellbore curvature and the change rate of the torsion of the 2nd survey interval, according to a principle of minimum comprehensive deviation of the curvature and the torsion of the upper survey station and the lower survey station of the 2nd survey interval on a premise that an angular deviation at the lower survey station of the 2nd survey interval is less than a specified value of 0.0002;

calculating the coordinate increment of the lower survey station relative to the upper survey station of the 2nd survey interval, according to the optimal values of the wellbore curvature, the torsion and the tool face angle of the upper survey station of the 2nd and the change rate of the wellbore curvature and the change rate of the torsion of the 2nd survey interval.

2. The method for self-adaptive survey calculation of a wellbore trajectory according to claim 1, wherein the coordinate increment comprises a vertical depth increment, a horizontal projection length increment, an N coordinate increment and an E coordinate increment.

3. The method for self-adaptive survey calculation of a wellbore trajectory according to claim 2, wherein the calculating, by using a conventional survey calculation method, a coordinate increment of a lower survey station relative to a upper survey station of a 1st survey interval, comprises:

calculating, according to a formula $\gamma_{01}=\arccos[\cos\alpha_0\cdot\cos\alpha_1+\sin\alpha_0\cdot\sin\alpha_1\cdot\cos(\varphi_1-\varphi_0)]$, a dogleg angle of the 1st survey interval, wherein $\gamma_{01}$ is the dogleg angle of the 1st survey interval; $\alpha_0$ is a well inclination angle of a 0th survey station, $\alpha_1$ is a well inclination angle of the 1st survey station, $\varphi_0$ is an azimuth angle of the 0th survey station, and $\varphi_1$ is an azimuth angle of the 1st survey station;

calculating, if the dogleg angle of the 1st survey interval is equal to zero, the coordinate increment of the lower survey station relative to the upper survey station of the 1st survey interval by using a following formula $$\begin{cases} \Delta D_{01} = (L_1 - L_0)\cdot\cos\alpha_0 \\ \Delta L_{p01} = (L_1 - L_0)\cdot\sin\alpha_0 \\ \Delta N_{01} = (L_1 - L_0)\cdot\sin\alpha_0\cdot\cos\varphi_0 \\ \Delta E_{01} = (L_1 - L_0)\cdot\sin\alpha_0\cdot\sin\varphi_0 \end{cases},$$

wherein $L_0$ is a well depth of the 0th survey station; $L_1$ is a well depth of the 1st survey station, $\Delta D_{01}$ is a vertical depth increment of the 1st survey interval, $\Delta L_{p01}$ is a horizontal projection length increment of the 1st survey interval, $\Delta N_{01}$ is an N coordinate increment of the 1st survey interval, and $\Delta E_{01}$ is an E coordinate increment of the 1st survey interval;

calculating, if the dogleg angle of the 1st survey interval is greater than zero, the coordinate increment of the lower survey station relative to the upper survey station of the 1st survey interval by using a following formula $$\begin{cases} \Delta D_{01} = R_{01}\cdot\tan(\gamma_{01}/2)\cdot(\cos\alpha_0+\cos\alpha_1) \\ \Delta L_{p01} = R_{01}\cdot\tan(\gamma_{01}/2)\cdot(\sin\alpha_0+\sin\alpha_1) \\ \Delta N_{01} = R_{01}\cdot\tan(\gamma_{01}/2)\cdot(\sin\alpha_0\cdot\cos\varphi_0+\sin\alpha_1\cdot\cos\varphi_1) \\ \Delta E_{01} = R_{01}\cdot\tan(\gamma_{01}/2)\cdot(\sin\alpha_0\cdot\sin\varphi_0+\sin\alpha_1\cdot\sin\varphi_1) \end{cases},$$

wherein $\Delta D_{01}$ is the vertical depth increment of the 1st survey interval, $\Delta L_{p01}$ is the horizontal projection length increment of the 1st survey interval, $\Delta N_{01}$ is the N coordinate increment of the 1st survey interval, $\Delta E_{01}$ is the E coordinate increment of the 1st survey interval, and $R_{01}$ is curvature radius of an arc of the 1st survey interval.

4. The method for self-adaptive survey calculation of a wellbore trajectory according to claim 2, wherein the calculating, by using the conventional survey calculation method, a coordinate increment of a lower survey station relative to a upper survey station of a last survey interval, comprises:

calculating, according to a formula $\gamma_{(m-1)m}=\arccos[\cos\alpha_{m-1}\cos\alpha_m+\sin\alpha_{m-1}\sin\alpha_m\cos(\varphi_m-\varphi_{m-1})]$, a dogleg angle of the last survey interval, wherein $\gamma_{(m-1)m}$ is a dogleg angle of an mth survey interval, $\alpha_m$ is a well inclination angle of the mth survey station, $\varphi_m$ is an azimuth angle of the mth survey station, $\alpha_{m-1}$ is a well inclination angle of an (m−1)th survey station and $\varphi_{m-1}$ is an azimuth angle of the (m−1)th survey station;

calculating, if the dogleg angle of the mth survey interval is equal to zero, the coordinate increment of the lower survey station relative to the upper survey station of the mth survey interval by using a following formula $$\begin{cases} \Delta D_{(m-1)m} = (L_m - L_{m-1}) \cdot \cos\alpha_m \\ \Delta L_{p(m-1)m} = (L_m - L_{m-1}) \cdot \sin\alpha_m \\ \Delta N_{(m-1)m} = (L_m - L_{m-1}) \cdot \sin\alpha_m \cdot \cos\varphi_m \\ \Delta E_{(m-1)m} = (L_m - L_{m-1}) \cdot \sin\alpha_m \cdot \sin\varphi_m \end{cases},$$

wherein $L_m$ is a well depth of the mth survey station, $L_{m-1}$ is a well depth of the (m−1)th survey station, $\Delta D_{(m-1)m}$ is a vertical depth increment of the mth survey interval, $\Delta L_{p(m-1)m}$ is a horizontal projection length increment of the mth survey interval, $\Delta N_{(m-1)m}$ is an N coordinate increment of the mth survey interval, and $\Delta E_{(m-1)m}$ is an E coordinate increment of the mth survey interval;

calculating, if the dogleg angle of the mth survey interval is greater than zero, the coordinate increment of the lower survey station relative to the upper survey station of the mth survey interval by using a following formula $$\begin{cases} \Delta D_{(m-1)m} = R_{(m-1)m} \cdot \tan(\gamma_{(m-1)m}/2) \cdot (\cos\alpha_{m-1} + \cos\alpha_m) \\ \Delta L_{p(m-1)m} = R_{(m-1)m} \cdot \tan(\gamma_{(m-1)m}/2) \cdot (\sin\alpha_{m-1} + \sin\alpha_m) \\ \Delta N_{(m-1)m} = R_{(m-1)m} \cdot \tan(\gamma_{(m-1)m}/2) \cdot (\sin\alpha_{m-1} \cdot \cos\varphi_{m-1} + \sin\alpha_m \cdot \cos\varphi_m) \\ \Delta E_{(m-1)m} = R_{(m-1)m} \cdot \tan(\gamma_{(m-1)m}/2) \cdot (\sin\alpha_{m-1} \cdot \sin\varphi_{m-1} + \sin\alpha_m \cdot \sin\varphi_m) \end{cases},$$

wherein $\Delta D_{(m-1)m}$ is the vertical depth increment of the mth survey interval, $\Delta L_{p(m-1)m}$ is the horizontal projection length increment of the mth survey interval, $\Delta N_{(m-1)m}$ is the N coordinate increment of the mth survey interval, $\Delta E_{(m-1)m}$ is the E coordinate increment of the mth survey interval, and $R_{(m-1)m}$ is curvature radius of an arc of the mth survey interval.

5. The method for self-adaptive survey calculation of a wellbore trajectory according to claim 3, wherein the calculating estimated values of wellbore curvature, torsion and a tool face angle of the upper survey station of the 2nd survey interval according to well depths, well inclination angles and azimuth angles of three survey stations corresponding to the 1st survey interval and the 2nd survey interval, comprises:

calculating, according to a formula $k_{1e} = \sqrt{k_{\alpha1}^2 + k_{\varphi1}^2 \sin\alpha_1^2}$, the estimated value of the wellbore curvature of the upper survey station of the 2nd survey interval, wherein al is a well inclination angle of a 1st survey station, $k_{1e}$ is an estimated value of wellbore curvature at the 1st survey station, $k_{\alpha1}$ is a change rate of a well inclination angle at the 1st survey station, and $k_{\varphi1}$ is a change rate of an azimuth angle at the 1st survey station;

calculating, according to a formula $$\tau_{1e} = \frac{k_{\alpha1}k_{\varphi1} - k_{\varphi1}k_{\alpha1}}{k_{1e}^2}\sin\alpha_1 + k_{\varphi1}\left(1 + \frac{k_{\alpha1}^2}{k_{1e}^2}\right)\cos\alpha_1,$$

the estimated value of the torsion of the upper survey station of the 2nd survey interval, wherein α1 is the well inclination angle of the 1st survey station, $k_{1e}$ is the estimated value of the wellbore curvature at the 1st survey station, $k_{\alpha1}$ is the change rate of the well inclination angle at the 1st survey station, $k_{\varphi1}$ is the change rate of the azimuth angle at the 1st survey station, $\dot{k}_{\alpha1}$ is the change rate of the well inclination angle at the 1st survey station, $\dot{k}_{\varphi1}$ is a change rate of the change rate of the azimuth angle at the 1st survey station, and $\tau_{1e}$ is an estimated value of torsion at the 1st survey station;

calculating, according to a formula $$\omega_{1e} = \frac{1}{2}\left[\begin{array}{l} \mathrm{sgn}(\Delta\varphi_{01}) \cdot \cos^{-1}\left(\frac{\cos\alpha_0 - \cos\alpha_1\cos\gamma_{01}}{\sin\alpha_1\sin\gamma_{01}}\right) \\ +\mathrm{sgn}(\Delta\varphi_{12}) \cdot \cos^{-1}\left(\frac{\cos\alpha_1\cos\gamma_{12} - \cos\alpha_2}{\sin\alpha_1\sin\gamma_{12}}\right) \end{array}\right],$$

the estimated value of the tool face angle of the upper survey station of the 2nd survey interval, wherein $\omega_{1e}$ is an estimated value of a tool face angle at the 1st survey station, $\Delta\varphi_{01}$ is an azimuth angle increment of the 1st survey interval, $\Delta\varphi_{12}$ is an azimuth angle increment of the 2nd survey interval, $\alpha_1$ is the well inclination angle of the 1st survey station, $\alpha_0$ is an well inclination angle of a 0th survey station, $\alpha_2$ is the well inclination angle of the 2nd survey station, $\gamma_{01}$ is a dogleg angle of the 1st survey interval, $\gamma_{12}$ is a dogleg angle of the 2nd survey interval.

6. The method for self-adaptive survey calculation of a wellbore trajectory according to claim 3, wherein the calculating estimated values of wellbore curvature, torsion and a tool face angle of the lower survey station of the 2nd survey interval according to well depths, well inclination angles and azimuth angles of three survey stations corresponding to the 2nd survey interval and the 3rd survey interval, comprises:

calculating, according to a formula $k_{2e} = \sqrt{k_{\alpha2}^2 + k_{\varphi2}^2 \sin_{\alpha2}^2}$, the estimated value of the wellbore curvature of the lower survey station of the 2nd survey interval, wherein α2 is a well inclination angle of a 2nd survey station, $k_{2e}$ is an estimated value of wellbore curvature at the 2nd survey station, $k_{\alpha2}$ is a change rate of the well inclination angle at the 2nd survey station, and $k_{\varphi2}$ is a change rate of an azimuth angle at the 2nd survey station;

calculating, according to a formula $$\tau_{2e} = \frac{k_{\alpha2}k_{\varphi2} - k_{\varphi2}k_{\alpha2}}{k_{2e}^2}\sin\alpha_2 + k_{\varphi2}\left(1 + \frac{k_{\alpha2}^2}{k_{2e}^2}\right)\cos\alpha_2,$$

the estimated value of the torsion of the lower survey station of the 2nd survey interval, calculating, according to a formula wherein α2 is the well inclination angle of the 2nd survey station, $k_{2e}$ is the estimated value of the wellbore curvature at the 2nd survey station, $k_{\alpha2}$ is the change rate of the well inclination angle at the 2nd survey station, $k_{\varphi2}$ is the change rate of the azimuth angle at the 2nd survey station, $\dot{k}_{\alpha2}$ is a change rate of the change rate of well inclination angle at the 2nd survey station, $\dot{k}_{\varphi2}$ is a change rate of the change rate of azimuth angle at the 2nd survey station, and $\tau_{2e}$ is an estimated value of torsion at the 2nd survey station;

calculating, according to a formula $$\omega_{2e} = \frac{1}{2}\left[\begin{array}{l} \mathrm{sgn}(\Delta\varphi_{12}) \cdot \cos^{-1}\left(\frac{\cos\alpha_1 - \cos\alpha_2\cos\gamma_{12}}{\sin\alpha_2\sin\gamma_{12}}\right) \\ +\mathrm{sgn}(\Delta\varphi_{23}) \cdot \cos^{-1}\left(\frac{\cos\alpha_2\cos\gamma_{23} - \cos\alpha_3}{\sin\alpha_2\sin\gamma_{23}}\right) \end{array}\right],$$

the estimated value of the tool face angle of the lower survey station of the 2nd survey interval, wherein $\omega_{2e}$ is an estimated value of a tool face angle at the 2nd survey station, $\Delta\varphi_{12}$ is an azimuth angle increment of the 2nd survey interval, $\Delta\varphi_{23}$ is an azimuth angel increment of the 3rd survey interval, $\alpha_1$ is a well inclination angle of the 1st survey station, $\alpha_2$ is a well inclination angle of the 2nd survey station, $\alpha_3$ is a well inclination angle of a 3rd survey station, $\gamma_{12}$ is a dogleg angle of the 2nd survey interval, and $\gamma_{23}$ is a dogleg angle of the 3rd survey interval.

7. The method for self-adaptive survey calculation of a wellbore trajectory according to claim 3, wherein the calculating an estimated average change rate of wellbore curvature, an estimated average change rate of torsion and an estimated tool face angle increment, between an upper survey station and a lower survey station of a 2nd survey interval, comprises:

calculating, according to a formula $$A_{k12} = \frac{k_{2e} - k_{1e}}{L_2 - L_1},$$

the estimated average change rate of wellbore curvature between the upper survey station and the lower survey station of the 2nd survey interval, wherein $A_{k12}$ is an average change rate of wellbore curvature of the 2nd survey interval, $L_1$ is a well depth of a 1st survey station, $L_2$ is a well depth of a 2nd survey station, $k_{1e}$ is an estimated value of wellbore curvature at the 1st survey station, and $k_{2e}$ is an estimated value of wellbore curvature at the 2nd survey station;

calculating, according to a formula $$A_{\tau 12} = \frac{\tau_{2e} - \tau_{1e}}{L_2 - L_1},$$

the estimated average change rate of the torsion between the upper survey station and the lower survey station of the 2nd survey interval, wherein $A_{\tau 12}$ is an average change rate of torsion of the 2nd survey interval, $\tau_{1e}$ is an estimated value of torsion at the 1st survey station, and $\tau_{2e}$ is an estimated value of torsion at the 2nd survey station;

calculating, according to a formula $$\Delta\omega_{12} = \begin{cases} (\omega_{2e} - \omega_{1e} + 2\pi) & (\omega_{2e} - \omega_{1e} < -\pi) \\ (\omega_{2e} - \omega_{1e}) & (-\pi \le \omega_{2e} - \omega_{1e} \le \pi) \\ (\omega_{2e} - \omega_{1e} - 2\pi) & (\omega_{2e} - \omega_{1e} > \pi) \end{cases},$$

the estimated tool face angle increment between the upper survey station and the lower survey station of the 2nd survey interval, wherein $\Delta\omega_{12}$ is a tool face angle increment of the 2nd survey interval, $\omega_{1e}$ is an estimated value of a tool face angle at the 1st survey station, and $\omega_{2e}$ is an estimated value of a tool face angle at the 2nd survey station.

* * * * *